US007547268B1

(12) United States Patent
Krull

(10) Patent No.: US 7,547,268 B1
(45) **Date of Patent: *Jun. 16, 2009**

(54) EXERCISE RESISTANCE METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 222 days.

This patent is subject to a terminal disclaimer.

(21) Appl. No.: 11/453,295

(22) Filed: Jun. 13, 2006

Related U.S. Application Data

(63) Continuation of application No. 10/843,841, filed on May 11, 2004, now Pat. No. 7,060,011, which is a continuation of application No. 09/796,220, filed on Feb. 28, 2001, now Pat. No. 6,733,424, which is a continuation-in-part of application No. 09/519,269, filed on Mar. 7, 2000, now Pat. No. 6,629,910, which is a continuation of application No. 08/939,845, filed on Sep. 29, 1997, now Pat. No. 6,033,350, said application No. 10/843,841 and a continuation-in-part of application No. 09/747,214, filed on Dec. 21, 2000, now Pat. No. 6,402,666.

(60) Provisional application No. 60/171,813, filed on Dec. 21, 1999.

(51) Int. Cl.
*A63B 21/06* (2006.01)
*A63B 21/075* (2006.01)

(52) U.S. Cl. ..... 482/98; 482/107

(58) Field of Classification Search ..... 482/92–94, 482/98, 99, 106–109
See application file for complete search history.

(56) References Cited

U.S. PATENT DOCUMENTS

| | | | | |
|---|---|---|---|---|
| 4,529,198 | A * | 7/1985 | Hettick, Jr. | 482/104 |
| 4,538,805 | A * | 9/1985 | Parviainen | 482/98 |
| 4,627,615 | A * | 12/1986 | Nurkowski | 482/98 |
| 4,834,365 | A * | 5/1989 | Jones | 482/100 |
| 5,637,064 | A * | 6/1997 | Olson et al. | 482/108 |
| 5,769,762 | A * | 6/1998 | Towley et al. | 482/93 |
| 6,033,350 | A * | 3/2000 | Krull | 482/98 |
| 6,629,910 | B1 * | 10/2003 | Krull | 482/98 |
| 6,679,816 | B1 * | 1/2004 | Krull | 482/107 |
| 6,733,424 | B2 * | 5/2004 | Krull | 482/98 |
| 6,746,381 | B2 * | 6/2004 | Krull | 482/108 |
| 6,896,645 | B1 * | 5/2005 | Krull | 482/107 |
| 6,899,661 | B1 * | 5/2005 | Krull | 482/107 |
| 6,902,516 | B2 * | 6/2005 | Krull | 482/98 |
| 6,997,856 | B1 * | 2/2006 | Krull | 482/104 |
| 7,060,011 | B1 * | 6/2006 | Krull | 482/107 |
| 7,066,867 | B2 * | 6/2006 | Krull | 482/108 |
| 7,128,697 | B1 * | 10/2006 | Krull | 482/108 |
| 7,387,597 | B2 * | 6/2008 | Krull | 482/108 |
| 2007/0167300 | A1 * | 7/2007 | Krull | 482/107 |

FOREIGN PATENT DOCUMENTS

| | | | |
|---|---|---|---|
| JP | 10118222 | A * | 5/1998 |
| WO | WO 9417869 | A1 * | 8/1994 |

* cited by examiner

*Primary Examiner*—Loan H Thanh
*Assistant Examiner*—Victor K Hwang

(57) ABSTRACT

Weights are disposed on opposite sides of a base member, and selector rods are selectively moved into engagement with the desired number of weights on each side of the base member.

10 Claims, 19 Drawing Sheets

Fig. 1
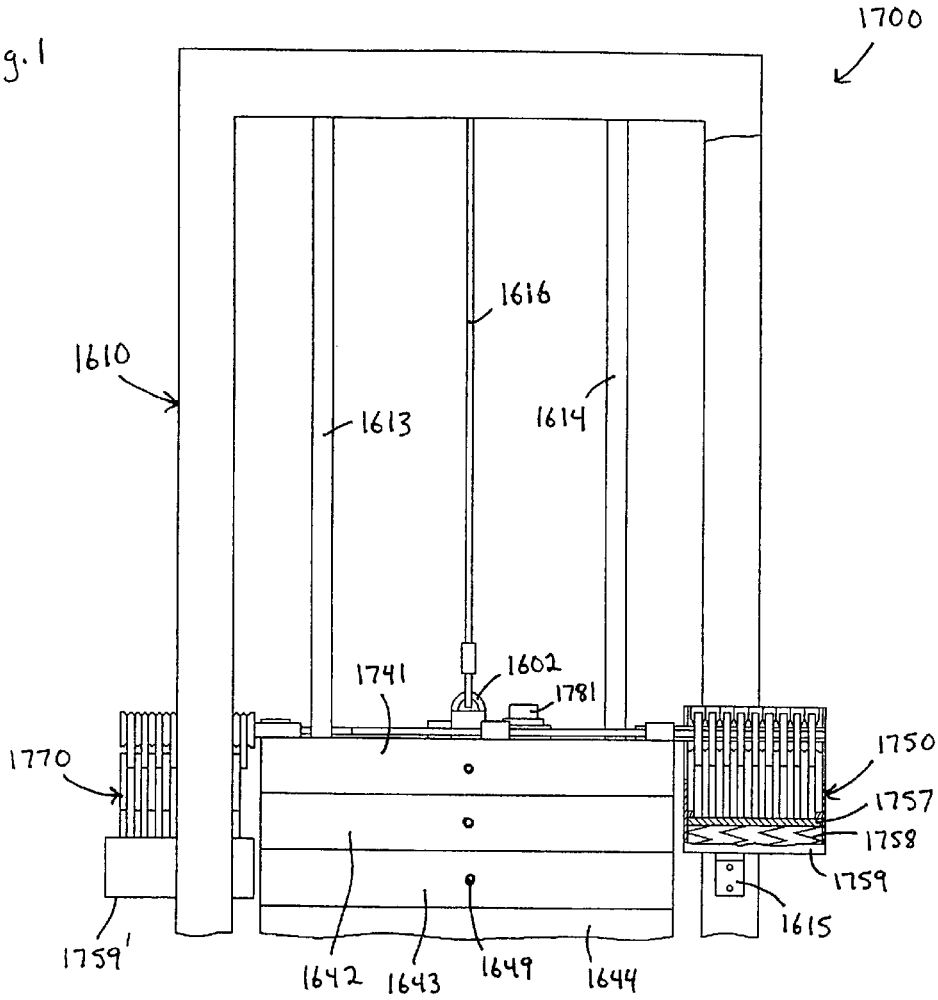
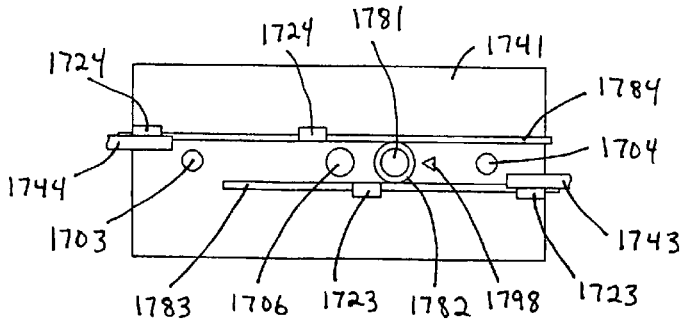
Fig. 2

Fig. 3
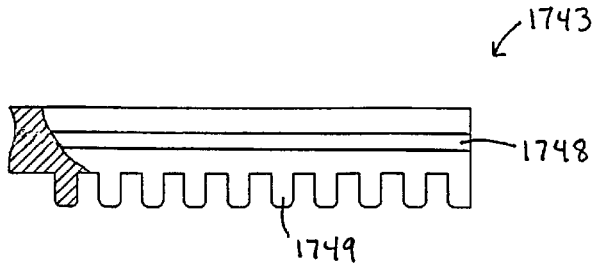
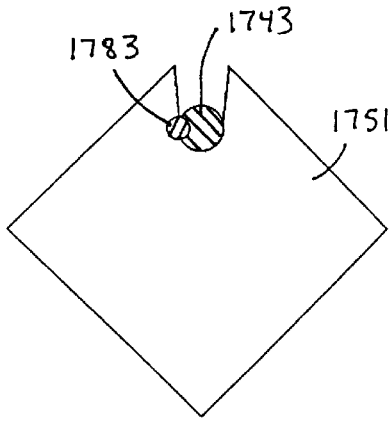
Fig. 5
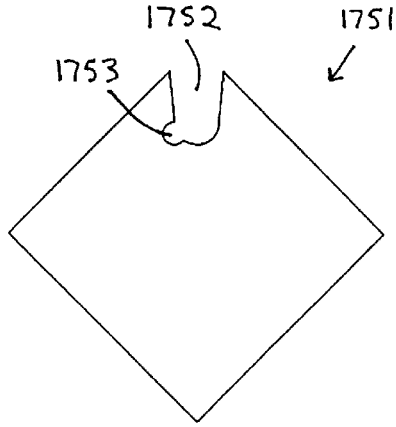
Fig. 4
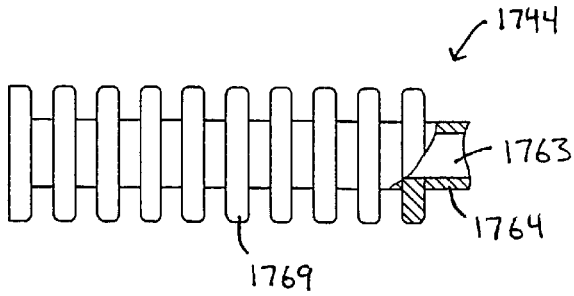
Fig. 6

Fig. 7a
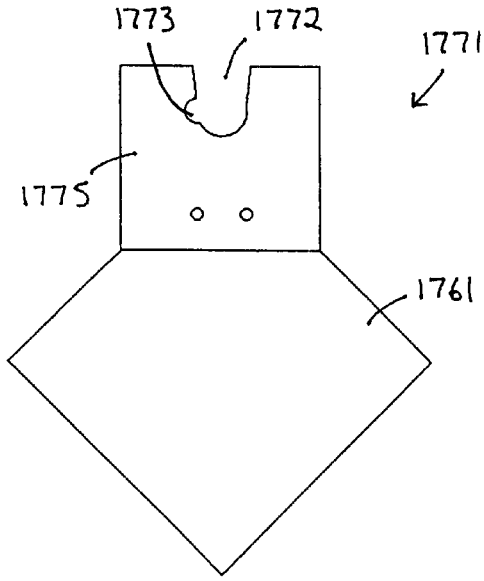
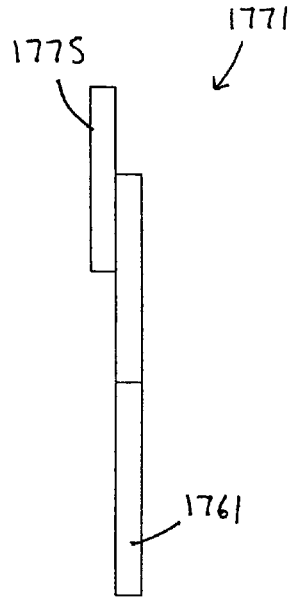
Fig. 7b
Fig. 8a
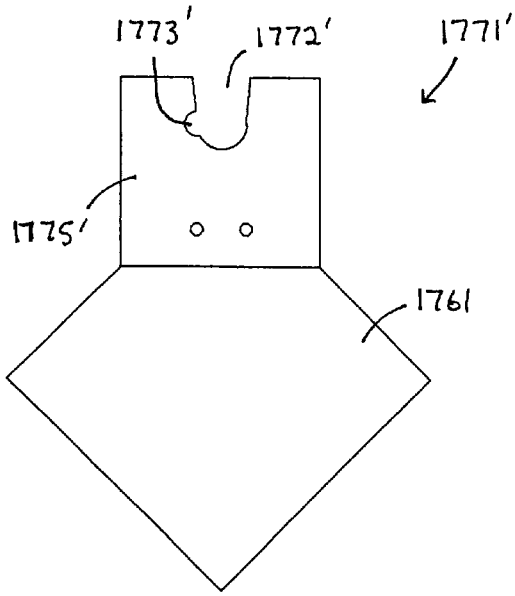
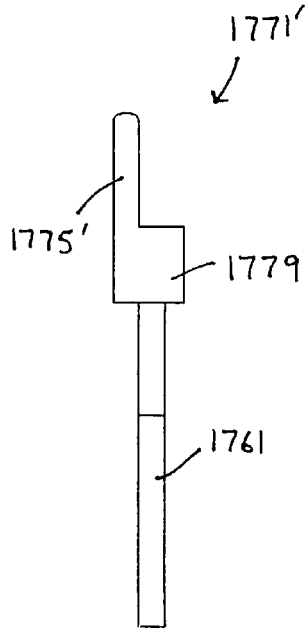
Fig. 8b

Fig. 21
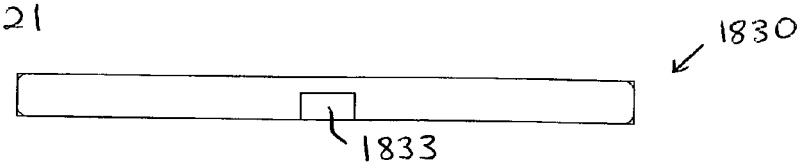
Fig. 22
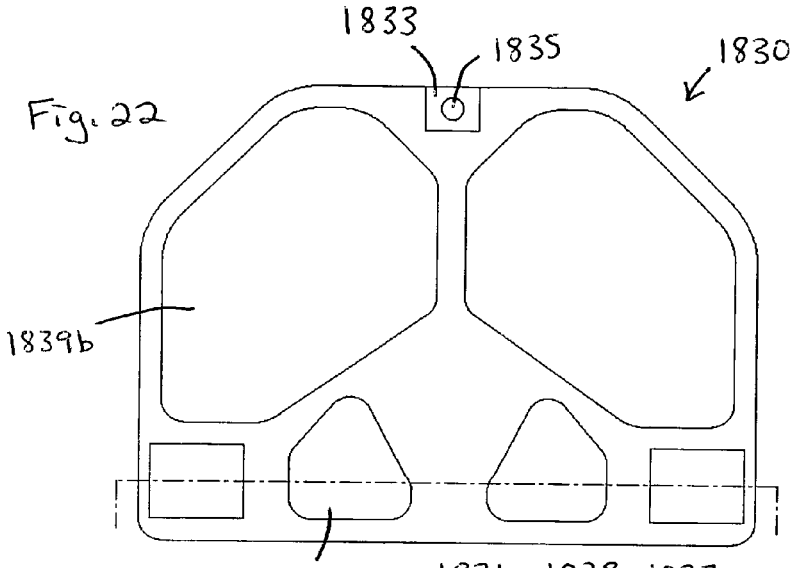
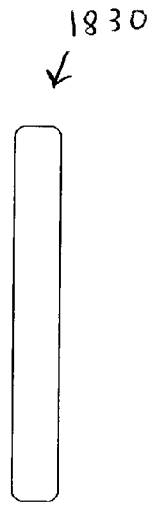
Fig. 23
Fig. 24
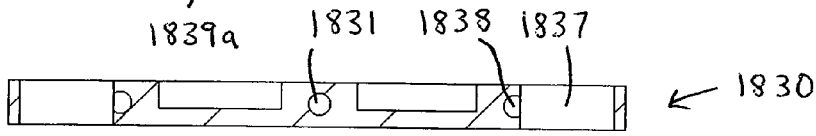
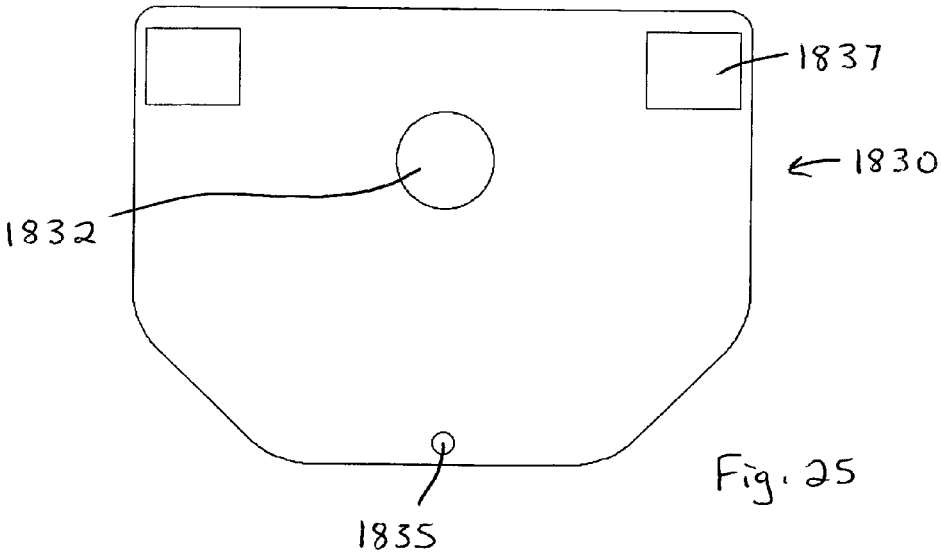
Fig. 25

Fig. 26
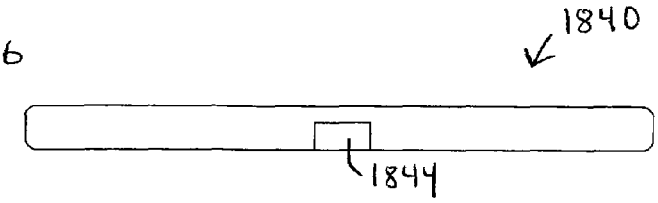
Fig. 27
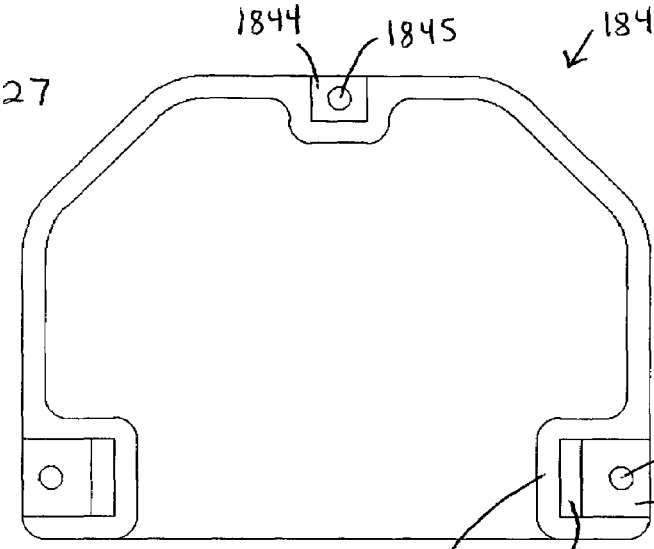
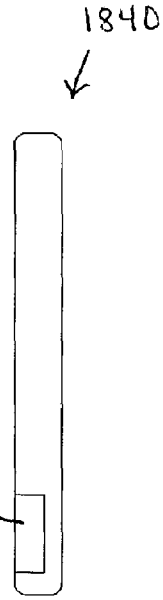
Fig. 28
Fig. 29
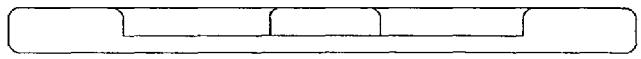
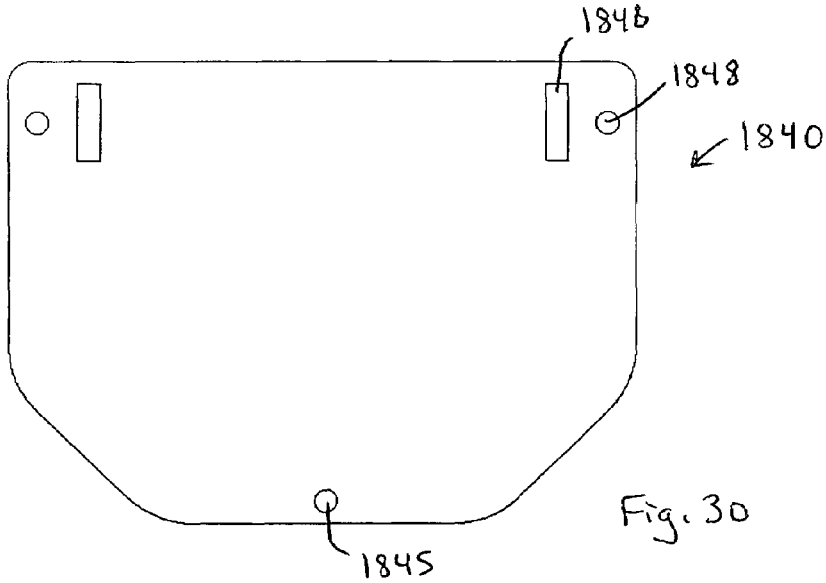
Fig. 30

1860
1863
1863
1864

1860
1868
1865
1879
1869
1871
1863
1867
1868
1864

1860
1866
1864

1878
1867
1860

1867
1868
1865
1869
1868

1868
1867
1865
1828
1827
1860
1879
1838
1830
1871
1864

Fig. 41
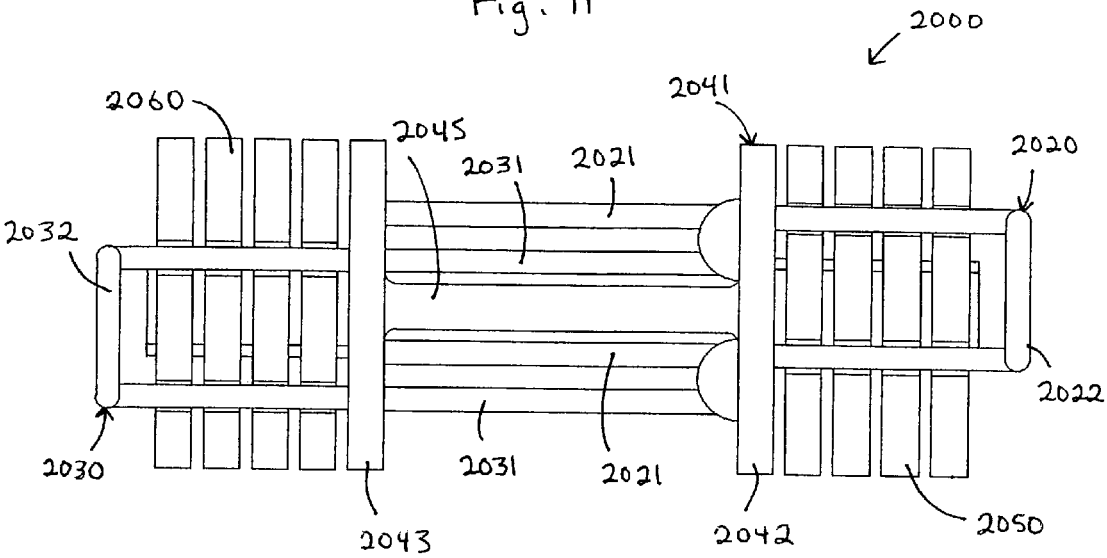
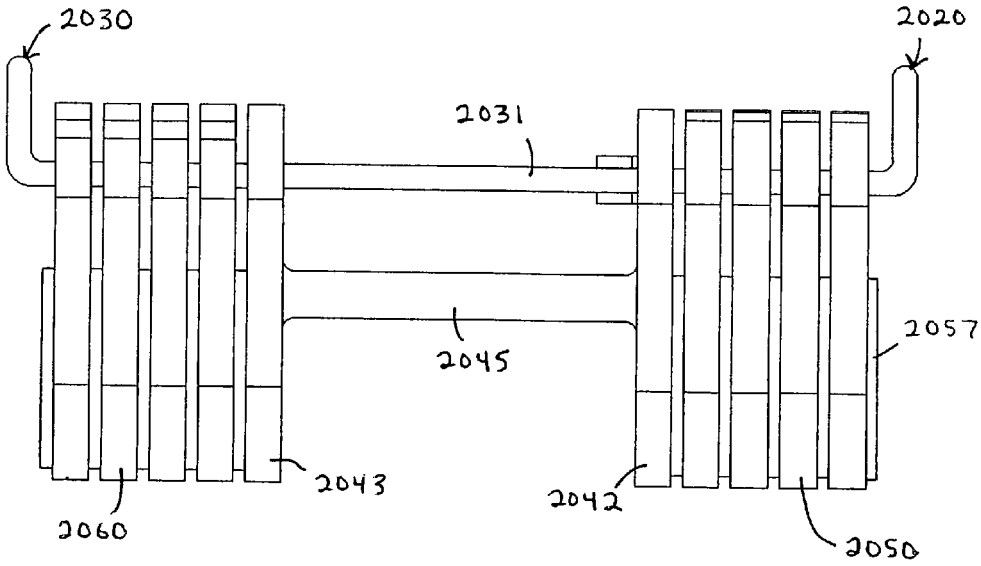
Fig. 42

Fig. 46
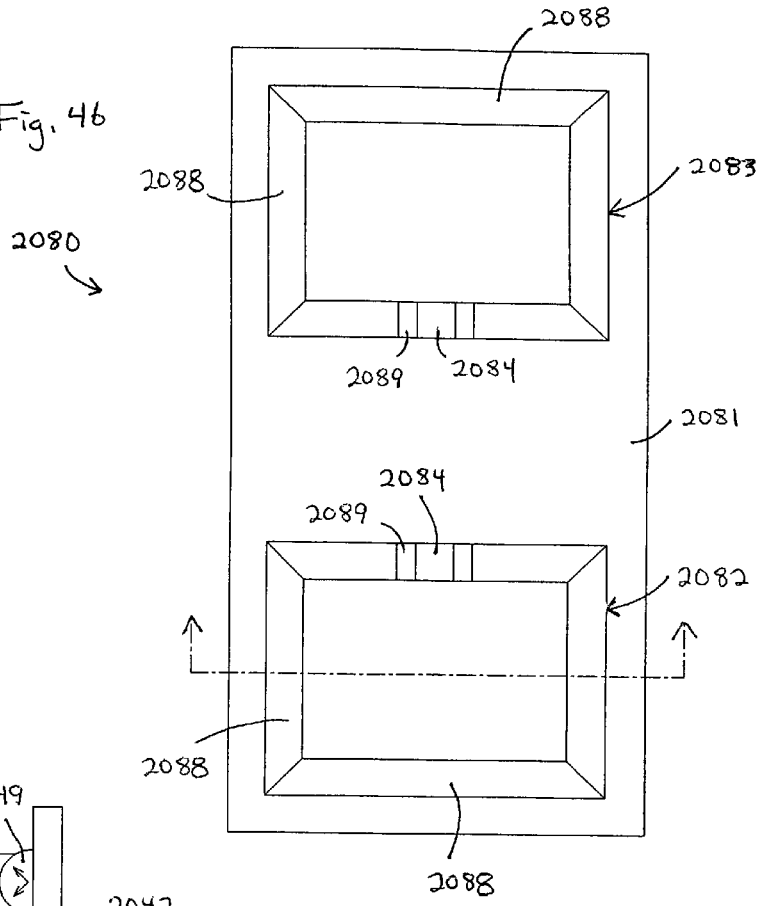
Fig. 47
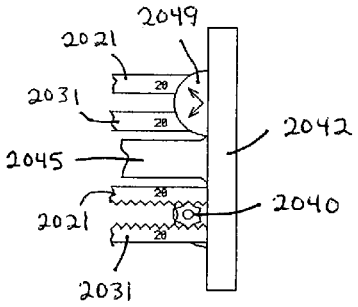
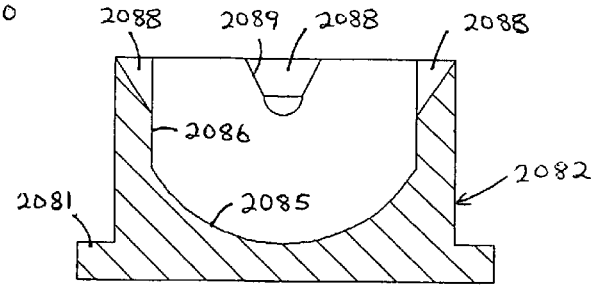
Fig. 46A

Fig. 52
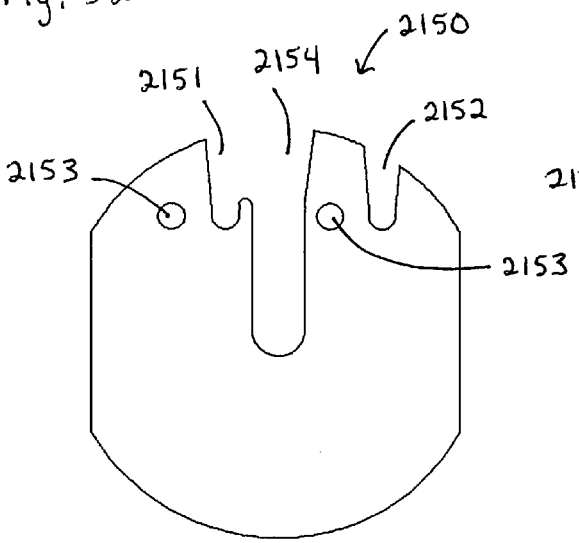
Fig. 51
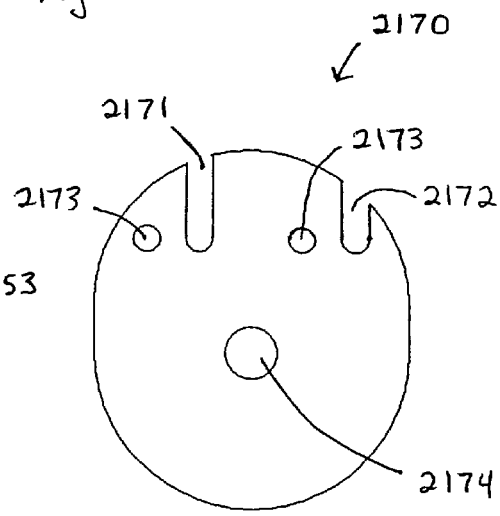
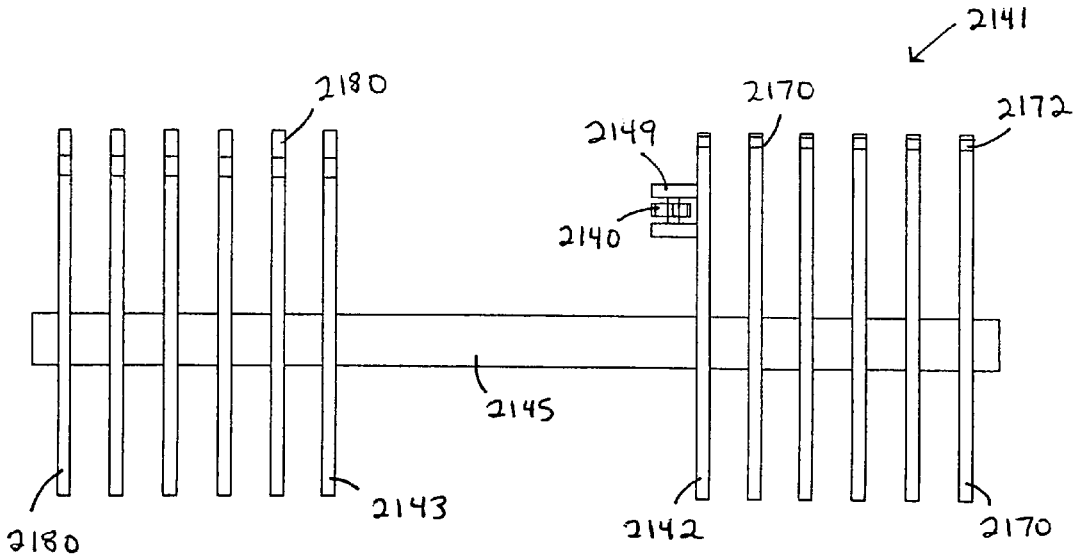
Fig. 50

2310
2308
2307
2370
2320
2364
2362
2323
2361

2310
2308
2307
2370
2320
2323
2364

2310
2308
2318
2328
2326
2323
2387
2388
2389
2380

2310
2318
2329
2325
2326
2398
2399
2396
2390

EXERCISE RESISTANCE METHODS AND APPARATUS

CROSS-REFERENCE TO RELATED APPLICATIONS

This is a continuation of U.S. patent application Ser. No. 10/843,841, filed May 11, 2004 (U.S. Pat. No. 7,060,011), which is a continuation of U.S. patent application Ser. No. 09/796,220, filed Feb. 28, 2001 (U.S. Pat. No. 6,733,424), which is (1) a continuation-in-part of U.S. patent application Ser. No. 09/519,269, filed Mar. 7, 2000 (U.S. Pat. No. 6,629,910), which is a continuation of U.S. patent application Ser. No. 08/939,845, filed Sep. 29, 1997 (U.S. Pat. No. 6,033,350); and (2) a continuation-in-part of U.S. patent application Ser. No. 09/747,214, filed Dec. 21, 2000 (U.S. Pat. No. 6,402,666), which discloses subject matter entitled to the filing date of U.S. Provisional No. 60/171,813, filed Dec. 21, 1999.

FIELD OF THE INVENTION

The present invention relates to exercise equipment and more particularly, to weight-based resistance to exercise movement.

BACKGROUND OF THE INVENTION

Various weight selection methods and apparatus have been developed to provide adjustable resistance to exercise. For example, exercise dumbbells are well known in the art and prevalent in the exercise equipment industry. Generally speaking, each dumbbell includes a handle and a desired number of weights or plates that are secured to opposite ends of the handle. The dumbbell is lifted up subject to gravitational force acting on the mass of the handle and attached weights.

On relatively advanced devices, the bar is stored in proximity to the weight plates, and a selection mechanism is provided to connect a desired amount of weight to the bar. Some examples of patented barbell/dumbbell improvements and/or features are disclosed in U.S. Pat. No. 4,284,463 to Shields (discloses a dumbbell assembly having opposite side weights which are maintained in alignment on a base and selectively connected to a handle by means of cam driven pins on the weights); U.S. Pat. No. 4,529,198 to Hettick, Jr. (discloses a barbell assembly having opposite side weights which are maintained in alignment on respective storage members and selectively connected to a handle by means of axially movable springs); U.S. Pat. No. 4,822,034 to Shields (discloses both barbell and dumbbell assemblies having opposite side weights which are maintained in alignment on a shelf and selectively connected to a handle by means of latches on the weights); U.S. Pat. No. 5,769,762 to Towley, III et al. (discloses a dumbbell assembly having a plurality of interconnected opposite side weights which are stored in nested relationship to one another and selectively connected to a handle by various means); and U.S. Pat. No. 5,839,997 to Roth et al. (discloses a dumbbell assembly having opposite side weights which are maintained in alignment on a base and selectively connected to a handle by means of eccentric cams on a rotating selector rod. Despite these advances and others in the field of free weight selection, room for improvement remains.

Exercise weight stacks are also well known in the art and prevalent in the exercise equipment industry. Generally speaking, a plurality of weights or plates are arranged in a vertical stack and maintained in alignment by guide members or rods. A desired amount of weight is engaged by selectively connecting a selector rod to the appropriate weight in the stack. The selector rod and/or the uppermost weight in the stack are/is connected to at least one force receiving member by means of a connector. The engaged weight is lifted up from the stack in response to movement of the force receiving member.

Some examples of conventional weight stacks, their applications, and/or features are disclosed in U.S. Pat. No. 3,912,261 to Lambert (shows an exercise machine which provides weight stack resistance to a single exercise motion); U.S. Pat. No. 5,263,915 to Habing (shows an exercise machine which uses a single weight stack to provide resistance to several different exercise motions); U.S. Pat. No. 4,900,018 to Ish III (shows an exercise machine which provides weight stack resistance to a variety of exercise motions); U.S. Pat. No. 4,878,663 to Luquette (shows an exercise machine which has rigid linkage members interconnected between a weight stack and a force receiving member); U.S. Pat. No. 4,601,466 to Lais (shows bushings which are attached to weight stack plates to facilitate movement along conventional guide rods); U.S. Pat. No. 5,374,229 to Sencil (shows an alternative to conventional guide rods); U.S. Pat. No. 4,878,662 to Chern (shows a selector rod arrangement for clamping the selected weights together into a collective mass); U.S. Pat. No. 4,809,973 to Johns (shows telescoping safety shields which allow insertion of a selector pin but otherwise enclose the weight stack); U.S. Pat. No. 5,000,446 to Sarno (shows discrete selector pin configurations intended for use on discrete machines); U.S. Pat. No. 4,546,971 to Raasoch (shows levers operable to remotely select a desired number of weights in a stack); U.S. Pat. No. 5,037,089 to Spagnuolo (shows a controller operable to automatically adjust weight stack resistance); U.S. Pat. No. 4,411,424 to Barnett (shows a dual-pronged pin which engages opposite sides of a selector rod); U.S. Pat. No. 1,053,109 to Reach (shows a stack of weight plates, each having a slide which moves into and out of engagement with the weight plate or top plate above it); and U.S. Pat. No. 5,306,221 to Itaru (shows a stack of weight plates, each having a lever which pivots into and out of engagement with a selector rod). Despite these advances and others, room for improvement and ongoing innovation continues to exist in the weight stack field, as well.

SUMMARY OF THE INVENTION

Generally speaking, the present invention involves the selection of a variable number of laterally aligned weight plates by means of laterally movable selector rods. Applications for the present invention include exercise dumbbells and/or on weight stack machines. Many of the features and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts throughout the several views, FIG. 1 is a partially sectioned, front view of an exercise weight stack apparatus constructed according to the principles of the present invention;

FIG. 2 is a top view of a top plate on the weight stack apparatus of FIG. 1;

FIG. 3 is a partially sectioned, front view of a part of a first supplemental weight assembly on the weight stack apparatus of FIG. 1;

FIG. 4 is an end view of another part of the first supplemental weight assembly on the weight stack apparatus of FIG. 1;

FIG. 5 is a partially sectioned, end view of the parts of FIGS. 2 and 3 keyed together;

FIG. 6 is a partially sectioned, front view of a part of a second supplemental weight assembly on the weight stack apparatus of FIG. 1;

FIG. 7*a* is an end view of another part of the second supplemental weight assembly on the weight stack apparatus of FIG. 1;

FIG. 7*b* is a front view of the part of FIG. 7*a;*

FIG. 8*a* is an end view of a suitable alternative for the part of FIG. 7*a;*

FIG. 8*b* is a front view of the part of FIG. 8*a;*

FIG. 21 is a top view of an inside end plate that is part of the dumbbell of FIG. 12;

FIG. 22 is an end view of the inside end plate of FIG. 21;

FIG. 23 is a side view of the inside end plate of FIG. 22;

FIG. 24 is a sectioned bottom view of the inside end plate of FIG. 22;

FIG. 25 is an opposite end view of the inside end plate of FIG. 22;

FIG. 26 is a top view of an outside end plate that is part of the dumbbell of FIG. 12;

FIG. 27 is an end view of the outside end plate of FIG. 26;

FIG. 28 is a side view of the outside end plate of FIG. 27;

FIG. 29 is a bottom view of the outside end plate of FIG. 27;

FIG. 30 is an opposite end view of the outside end plate of FIG. 27;

FIG. 41 is a top view of another dumbbell constructed according to the principles of the present invention;

FIG. 42 is a front view of the dumbbell of FIG. 41;

FIG. 46 is a top view of a housing or stand for the dumbbell of FIGS. 41-42;

FIG. 46A is a sectioned end view of the housing of FIG. 46;

FIG. 47 is a partially sectioned, top view of a portion of the dumbbell of FIGS. 41-42;

FIG. 50 is a front view of a base member which is part of the dumbbell of FIGS. 48-49;

FIG. 51 is an end view of a spacer which is part of the base member of FIG. 50;

FIG. 52 is an end view of a weight which is part of the dumbbell of FIGS. 48-49;

DETAILED DESCRIPTION OF A PREFERRED EMBODIMENT

Figure 9:
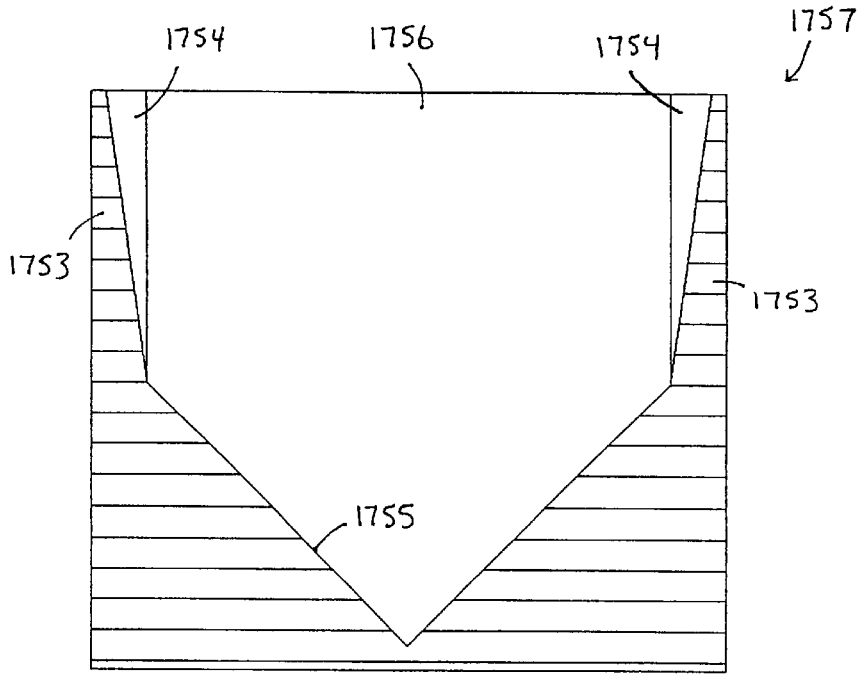
FIG. 9 is an end view of yet another part of the weight stack apparatus of FIG. 1.

Generally speaking, the present invention allows a person to adjust weight resistance by moving one or more selector rods axially into engagement with a desired number of weights. The present invention may be applied to exercise weight stacks and/or free weight assemblies such as dumbbells.

FIG. 1 shows an exercise weight stack machine 1700 constructed according to the principles of the present invention. The weight stack machine 1700 generally includes a frame 1610, a base member 1741, a vertical stack of weights 1642-1644 underlying the base member 1741, and first and second weight assemblies 1750 and 1770 disposed on opposite sides of the base member 1741. The two assemblies 1750 and 1770 show two different ways to selectively engage weights disposed on opposite sides of a base member (in this case, the top plate 1741).

Holes 1703 and 1704 are formed through the base member 1741 (and through the weights 1642-1644) to accommodate respective guide rods 1613 and 1614. Another hole 1706 is formed through the base member 1741 (and through the weights 1642-1644) to accommodate a selector rod of the type known in the art and fastened to the top plate 1741. Transverse holes extend through the selector rod and align with transverse holes 1649 through the weights 1642-1644 to accommodate a selector pin. One end of a cable 1616 is connected to the selector rod by means of a catch 1602. An opposite end of the cable 1616 is connected to a force receiving member.

A knob 1781 and a gear 1782 are mounted on the base member 1741 and rotate together about a common axis of rotation relative to the base member 1741. Diametrically opposed portions of the gear 1782 engage respective rods 1783 and 1784 which are movably mounted on the base member 1741 by means of respective supports 1723 and 1724. Gear teeth are provided on the rods 1783 and 1784 to engage the teeth on the gear 1782 in such a manner that rotation of the latter causes the former to move in opposite directions relative to the base member 1741. Gear teeth are disposed only on discrete portions of the rods 1783 and 1784 so as to limit travel of the rods 1783 and 1784 relative to the base member 1741. Another way to impose this sort of limitation is to secure stops to the rods 1783 and 1784. An indicator 1798 is provided on the base member 1741 to cooperate with indicia on the knob 1781 and/or the gear 1782 to indicate the orientation of both relative to the base member 1741.

On the right side of the apparatus 1700, a bar 1743 is rigidly secured to the base member 1741 and spans the weight assembly 1750. As shown in FIG. 3, a groove 1748 extends the length of the bar 1743, and fingers 1749 project downward from the bar 1743. The profile of the groove 1748 has a radius of curvature comparable to that of the rod 1783. As shown in FIG. 4, an upwardly opening slot 1752 is formed in each weight 1751 in the assembly 1750 to accommodate the bar 1743. The fingers 1749 on the bar 1743 insert between the weights 1751 to maintain proper spacing therebetween. A notch 1753 is formed in each weight 1751 proximate the lower end of the slot 1752. The notch 1753 has a radius of curvature comparable to that of the groove 1748 and cooperates therewith to define a keyway sized and configured to receive the rod 1783, as shown in FIG. 5.

The supplemental weight assembly 1750 is mounted on the frame 1610 to the right of the base member 1741 (as shown in FIG. 1). Brackets 1615 rigidly connect the opposite sides of the bottom of the weight assembly 1750 to the frame 1610. When everything is at rest, the bar 1743 occupies the position shown in FIG. 5 relative to the weights 1751, and the rod 1783 is movable through the keyway and into the engagement with the weights 1751.

The weights 1751 are disposed in a box 1757 which is shown in greater detail in FIG. 9. The box 1757 has opposing sidewalls 1753, which may be described as inwardly converging. The sidewalls 1753 form junctures with opposing base walls 1755, which may be described as more severely inwardly converging. Notches in the sidewalls 1753 are bounded by notch walls 1754 which may also be described as inwardly converging (though with respect to planes extending parallel to the drawing sheet for FIG. 9, as opposed to a single plane extending perpendicular thereto). The sidewalls 1753, the notch walls 1754, and the base walls 1755 are configured to guide the weights 1751 back into their proper positions or slots 1756 within the box 1757.

The box 1757 is movably mounted within a housing 1759 and is supported from below by shock absorbing springs 1758. The springs 1758 are disposed between the bottom wall of the box 1757 and the bottom wall of the housing 1759. The springs 1758 bias the box 1757 upward against pegs which project inward from the end walls of the box 1757. The shock absorbing springs 1658 are provided to accommodate downward impact which might occur at the conclusion of an exercise stroke.

Those skilled in the art will recognize that the assembly 1750 holds the weights 1751 in place prior to selection; keeps the weights 1751 spaced apart to ensure proper selection; supports the weights 1751 during exercise motion; and returns the weights 1751 to their proper location at the conclusion of exercise motion. Additional advantages of this embodiment 1750 include the elimination of guides extending along the weights' path of travel, and the ability to use a relatively smaller diameter selector rod (in combination with the bar).

On the other side of the apparatus 1700, a bar 1744 is rigidly secured to the base member 1741 and spans the weight assembly 1770. As shown in FIG. 6, the bar 1744 includes a solid steel shaft 1763 inserted into a plastic sleeve 1764. A groove (not shown) extends the length of the bar 1744, and relatively large diameter rings 1769 project radially outward from the sleeve 1764. The profile of the groove has a radius of curvature comparable to that of the rod 1784. As shown in FIGS. 7*a*-7*b*, each weight 1771 includes a relatively high mass member 1761 secured to a guide member 1775 by screws or other fasteners. An upwardly opening slot 1772 is formed in each guide member 1775 to accommodate the bar 1744. The rings 1769 on the bar 1744 insert between the guide members 1775 to maintain proper spacing between the weights 1771. A notch 1773 is formed in each guide member 1775 proximate the lower end of the slot 1772. The notch 1773 has a radius of curvature comparable to that of the groove and cooperates therewith to define a keyway sized and configured to receive the rod 1784 (in a manner similar to that shown in FIG. 5).

The supplemental weight assembly 1770 is mounted on the frame 1610 to the left of the base member 1741 (as shown in FIG. 1). Brackets 1615 rigidly connect the opposite sides of the bottom of the weight assembly 1770 to the frame 1610. When everything is at rest, the bar 1744 occupies the bottom portion of each slot 1757, and the rod 1784 is movable through the resulting keyways and into the engagement with the weights 1771. The assembly also includes a housing 1759' which is functionally similar to that on the assembly 1750.

Those skilled in the art will recognize that the assembly 1770 holds the weights 1771 in place prior to selection; keeps the weights 1771 spaced apart to ensure proper selection; supports the weights 1771 during exercise motion; and returns the weights 1771 to their proper location at the conclusion of exercise motion; and further, requires a relatively smaller diameter selector rod (in combination with the bar), and does not require guides extending along the weights' path of travel. Moreover, the assembly 1770 uses injection molded parts to eliminate milling procedures which might otherwise be required during manufacture.

An alternative weight 1771', which is suitable for use in the assembly 1770, is shown in FIGS. 8*a*-8*b*. Like the previous weight 1771, the weight 1771' includes a relatively high mass member 1761 connected to a guide member 1775' by screws or other suitable means. Like the previous guide member 1775, the guide member 1775' includes a slot 1772' to accommodate the bar 1744 and a notch 1773' to accommodate the rod 1784. However, the guide member 1775' provides a shoulder or spacer 1779 on an opposite side of the high mass member 1761 and cooperates with counterparts on adjacent weights to establish the effective spacing of the weights 1771'.

Figure 10:
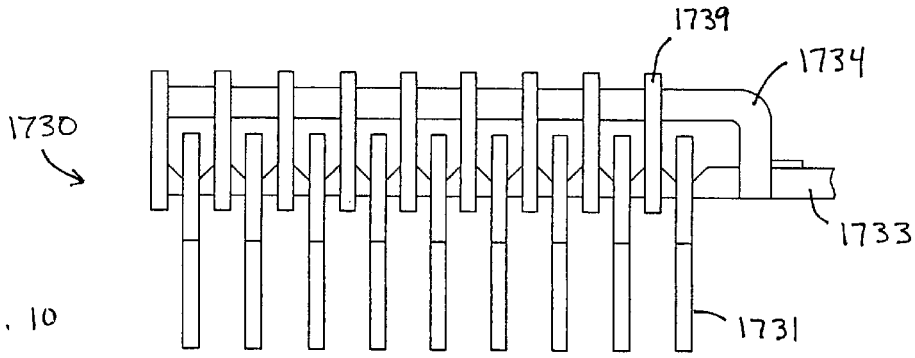
FIG. 10 is a front view of another weight selection assembly constructed according to the principles of the present invention.
Figure 11:
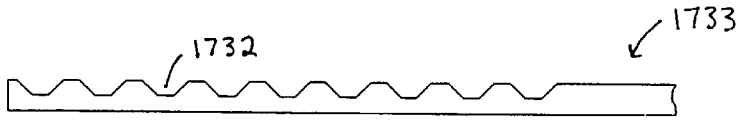
FIG. 11 is a front view of a part of the weight selection assembly of FIG. 10.

An alternative bar and rod combination is designated as 1730 in FIGS. 10-11. The assembly 1730 includes a bar 1734 of the type which may be rigidly secured to the base member 1741 in place of the bar 1744, for example. Downwardly projecting tabs 1739 are secured to the bar 1734 at spaced locations along the longitudinal axis thereof. Holes are formed through the tabs 1739 to receive a rod 1733 of the type which may be movably mounted to the base member 1741 in place of the rod 1784, for example. Upwardly opening notches 1732 are formed in the rod 1733 at spaced locations along the longitudinal axis thereof.

Weights 1731, which are similar in overall shape to the weights 1751, are maintained at spaced intervals in a housing similar to that designated as 1759 in FIG. 1. A hole is formed through each weight 1731 to receive the selector rod 1733. Advantages of this particular arrangement of parts include that the weights 1731 are encouraged to rest within respective notches 1732 when engaged by the selector rod 1733, and that the bar 1734 contributes to the structural integrity of the rod 1733. Those skilled in the art will also recognize that this assembly 1730, as well as the others described herein, may include weights of other sizes and/or shapes.

On a preferred embodiment, the underlying weights 1642 are relatively heavy (e.g. thirty pounds each), and the opposite side weights 1751 or 1771 are relatively light (e.g. three pounds per pair). The provision of six thirty-pound weights beneath the top plate and nine three-pound weights, together with a thirty pound top plate, provides resistance to exercise which (i) ranges from thirty pounds to two hundred and thirty-seven pounds and (ii) is adjustable in balanced, three pound increments (or out of balance one and one-half pound increments, if opposite side weights are not engaged in pairs). In the event that a counterweight is provided to offset the weight of the top plate, the same weights would provide resistance to exercise ranging from zero pounds to two hundred and seven pounds.

Figure 12:
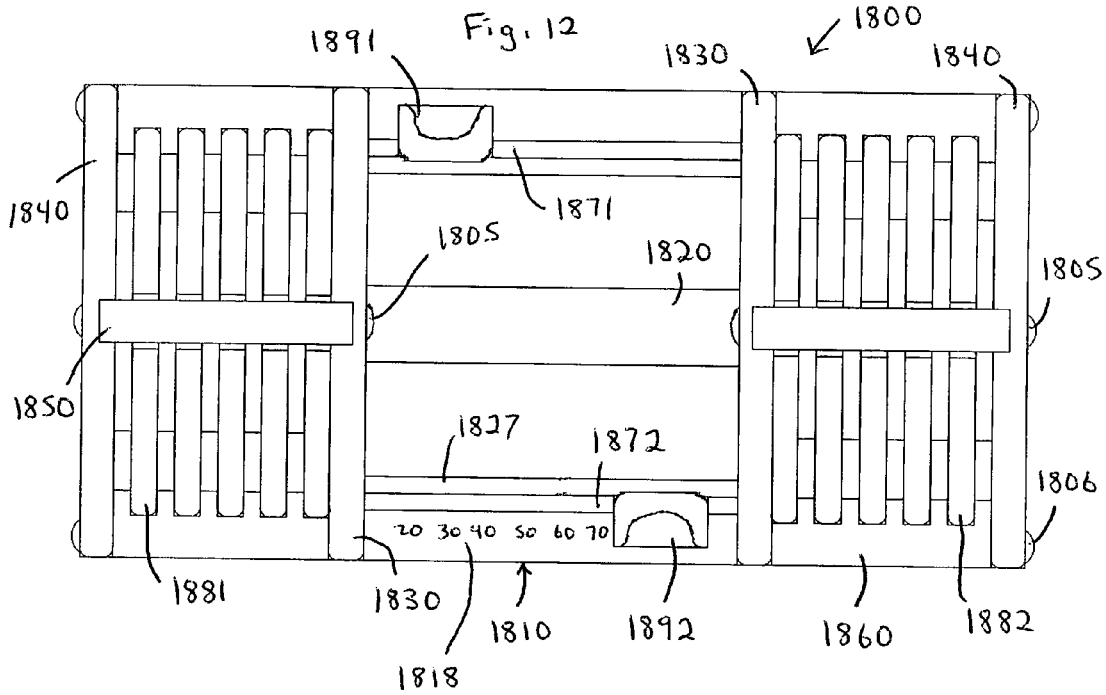
FIG. 12 is a top view of an exercise dumbbell constructed according to the principles of the present invention.
Figure 13:
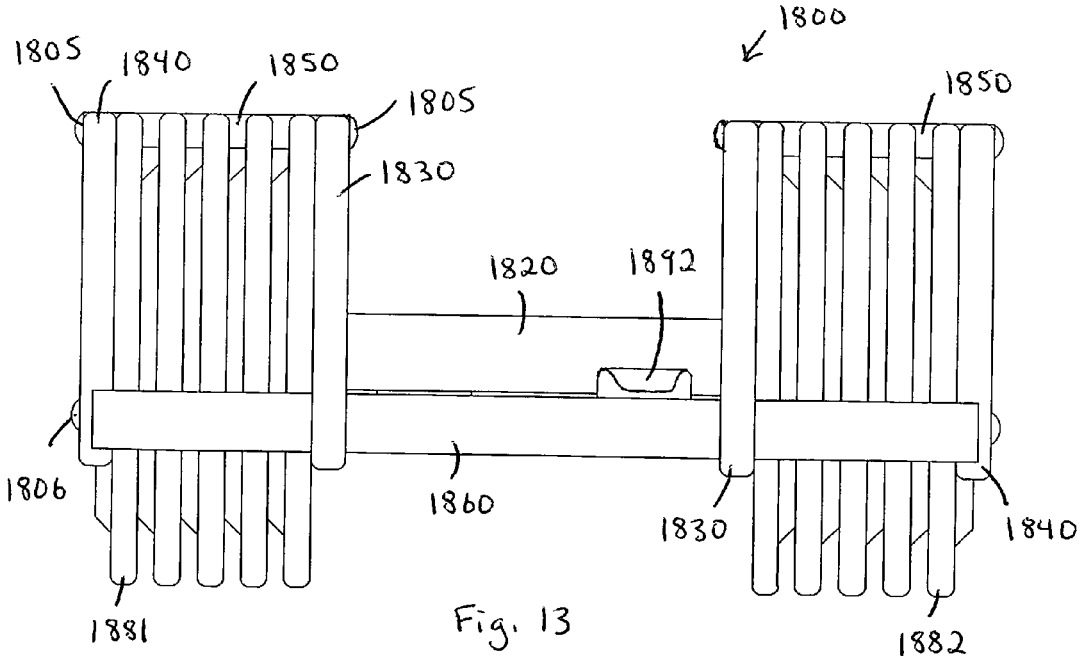
FIG. 13 is a side view of the dumbbell of FIG. 12.
Figures 14, 15, 16, 17, 18, 19, 20:
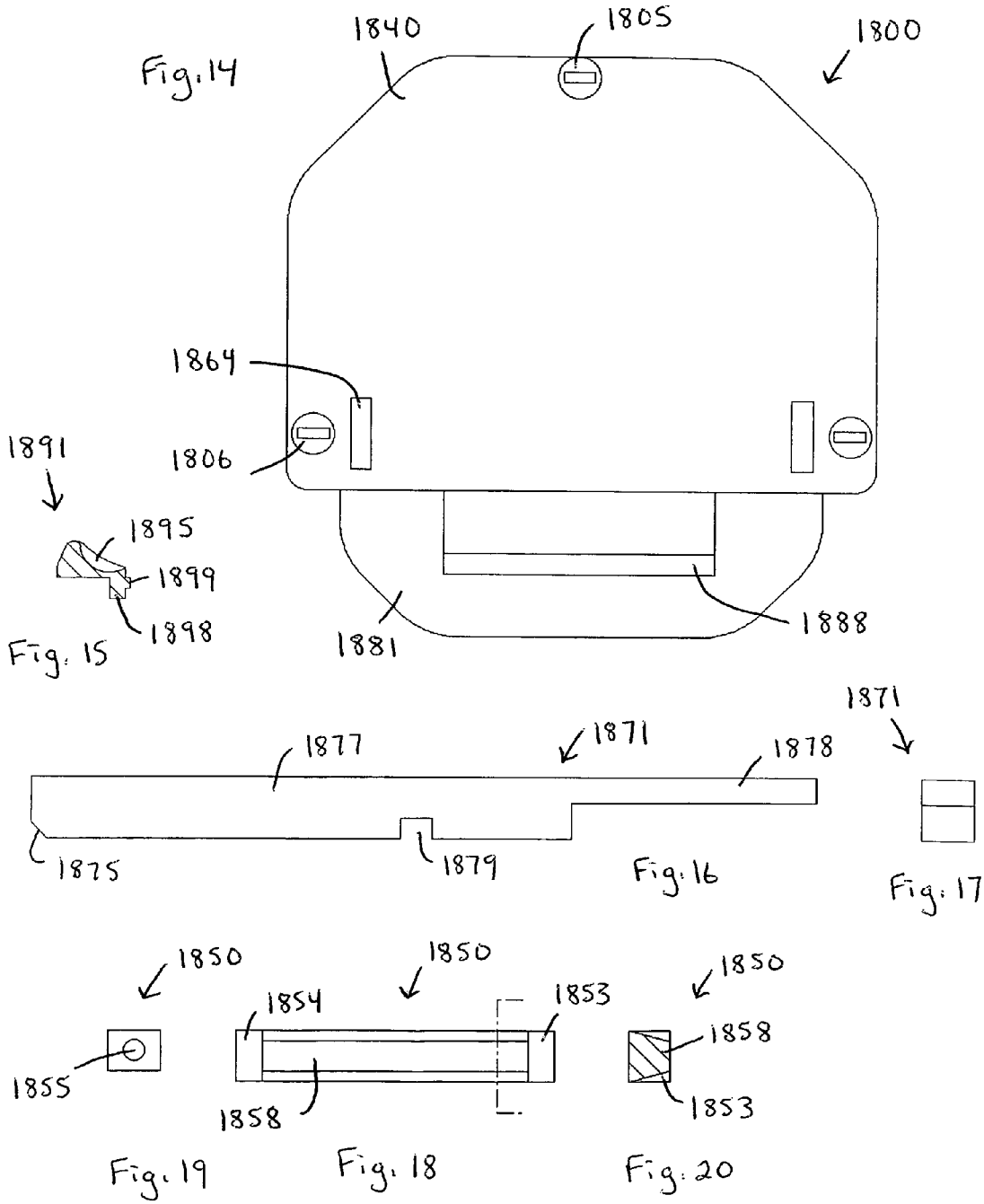
FIG. 14 is an end view of the dumbbell of FIG. 12.
FIG. 15 is a sectioned end view of a button that is part of the dumbbell of FIG. 12.
FIG. 16 is a top view of a selector rod that is part of the dumbbell of FIG. 12.
FIG. 17 is an end view of the selector rod of FIG. 16.
FIG. 18 is a bottom view of a strut that is part of the dumbbell of FIG. 12.
FIG. 19 is an end view of the strut of FIG. 18.
FIG. 20 is a sectioned end view of the strut of FIG. 18.

FIGS. 12-14 show an exercise dumbbell 1800 constructed according to the principles of the present invention. Generally speaking, the dumbbell 1800 includes a handle assembly 1810 and a plurality of weight plates 1881 and 1882 that are selectively connected to the handle assembly 1810. The weight plates 1881 and 1882 are supported by a cradle (not shown) when not in use.

The handle assembly 1810 includes a handle 1820 that may be described as a cylindrical bar sized and configured for grasping. Opposite ends of the handle 1820 are secured to respective end plates 1830, one of which is shown by itself in FIGS. 21-25. The depicted end plate 1830 has a circular opening 1832 that extends into the "inboard" face of the end plate 1830 (facing toward the handle 1820), and is sized and configured to receive and end of the handle 1820. A circular hole 1831 extends upward from the bottom of the end plate 1830 and intersects the opening 1832, thereby allowing a screw to be interconnected between the end plate 1830 and a respective end of the handle 1820. First and second rectangular openings 1837 extend through the end plate 1830, proximate opposite sides thereof, to accommodate passage of respective selector rods 1871, 1872 and receive associated support members 1827 and 1860. Respective holes 1838 extend upward from the bottom of the end plate 1830 to allow respective members 1827 to be secured to the end plate 1830 by means of respective screws. A rectangular notch 1833 extends into the "outboard" face of the end plate 1830 (facing away from the handle 1820), and is sized and configured to receive an end of a respective strut 1850 that is more fully described below. A circular hole 1835 extends through the end plate 1830 proximate the center of the notch 1833 to facilitate interconnection of a screw between the end plate 1830 and the strut 1850. Recesses **1839*a* and 1839*b* extend into the outboard face of the end plate 1830 to reduce the amount of material comprising the end plate 1830**.

One of the struts 1850 is shown by itself in FIGS. 18-20. The depicted strut 1850 may be described as a bar having a rectangular profile at each end 1853 and 1854, and a trapezoidal profile along an intermediate portion 1858 disposed between the ends 1853 and 1854. A respective hole 1855 extends into each of the ends 1853 and 1854 to receive a respective screw 1805. The end 1853 is sized and configured to fit within the notch 1833 in a respective end plate 1830. Similarly, the end 1854 is sized and configured to fit within a notch 1844 in a respective end plate 1840, which is disposed at a respective end of the dumbbell 1800.

One of the end plates 1840 is shown by itself in FIGS. 26-30. The depicted end plate 1840 has a profile similar to that of the end plate 1830. A rectangular notch 1844 extends into the "inboard" face of the end plate 1840 (facing toward the handle 1820), and aligns with the notch 1833 in the opposing end plate 1830. The notch 1844 is sized and configured to receive the end 1854 of a respective strut 1850. A circular hole 1845 extends through the end plate 1840 proximate the center of the notch 1844 to receive a respective screw 1805. On the "inboard" face of the end plate 1840, a rim 1841 extends about the perimeter of the end plate 1840, except for a central bottom portion. At each lower corner of the end plate 1840, the rim 1841 defines a rectangular cavity 1849 sized and configured to receive an end of a respective rail 1860 that is more fully described below. Within each cavity 1849, a rectangular slot 1846 and a circular hole 1848 extend through the end plate 1840 for reasons discussed below.

First and second rails 1860 are interconnected between both end plates 1840 and both end plates 1830. One of the rails 1860 is shown by itself in FIGS. 31, 33, and 35, and relative to certain interacting components in FIGS. 32, 34, and 36. The depicted rails may be generally described as a bar having solid distal ends and a U-shaped cross-section extending therebetween. The U-shaped cross-section defines a groove 1867 sized and configured to slidably support a respective selector rod 1871 or 1872, as more fully discussed below.

Figures 31, 32, 33, 34, 35, 36:
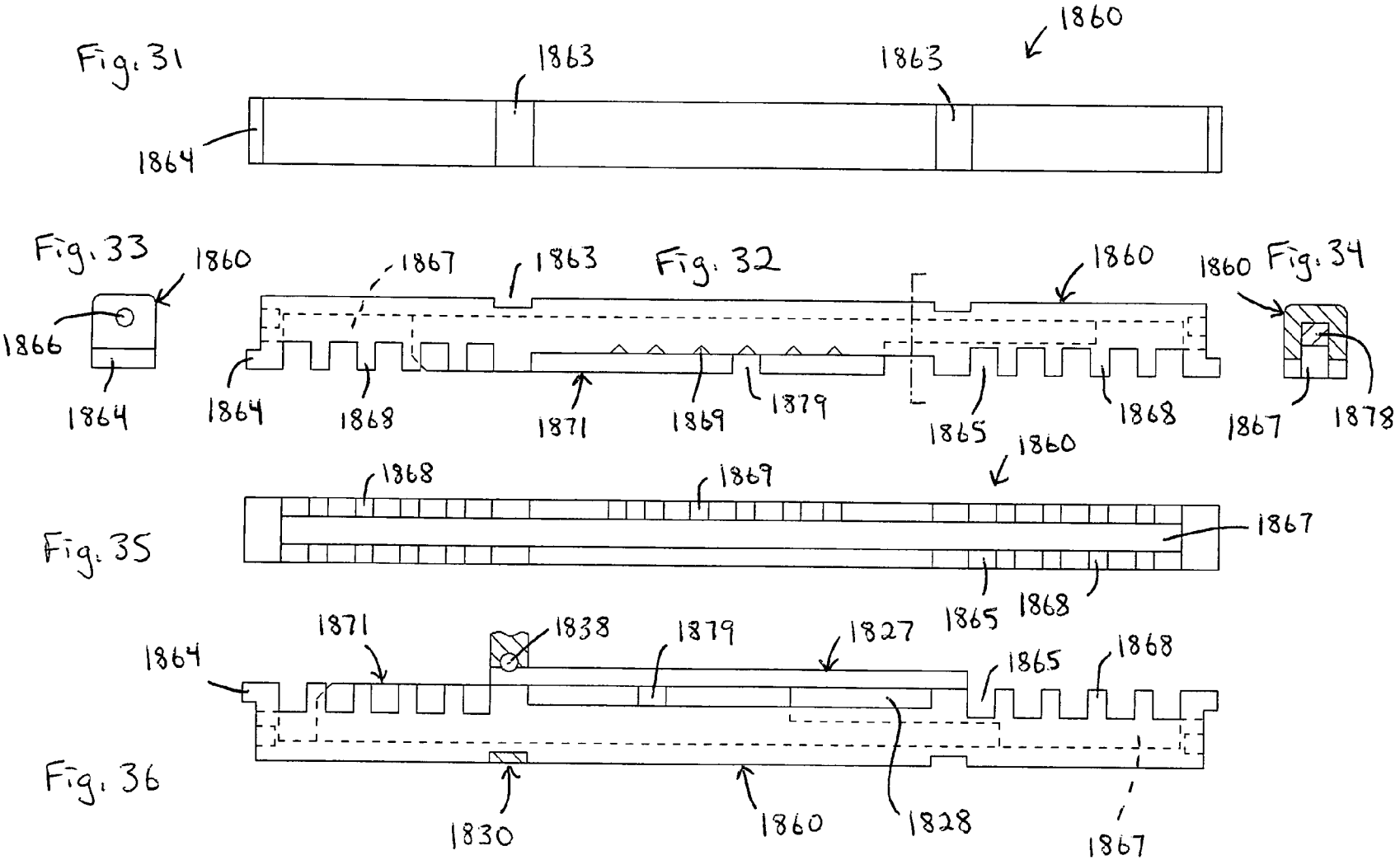
FIG. 31 is a side view of a rail that is part of the dumbbell of FIG. 12.
FIG. 32 is a top view of the rail of FIG. 31, shown together with a selector rod that is part of the dumbbell of FIG. 12.
FIG. 33 is an end view of the rail of FIG. 32.
FIG. 34 is a sectioned end view of the rail and selector rod of FIG. 32.
FIG. 35 is an opposite side view of the rail of FIG. 31.
FIG. 36 is a bottom view of the rail and selector rod of FIG. 32, shown together with a fragmentary portion of the inside end plate of FIGS. 21-25.
Figures 37, 38, 39, 40:
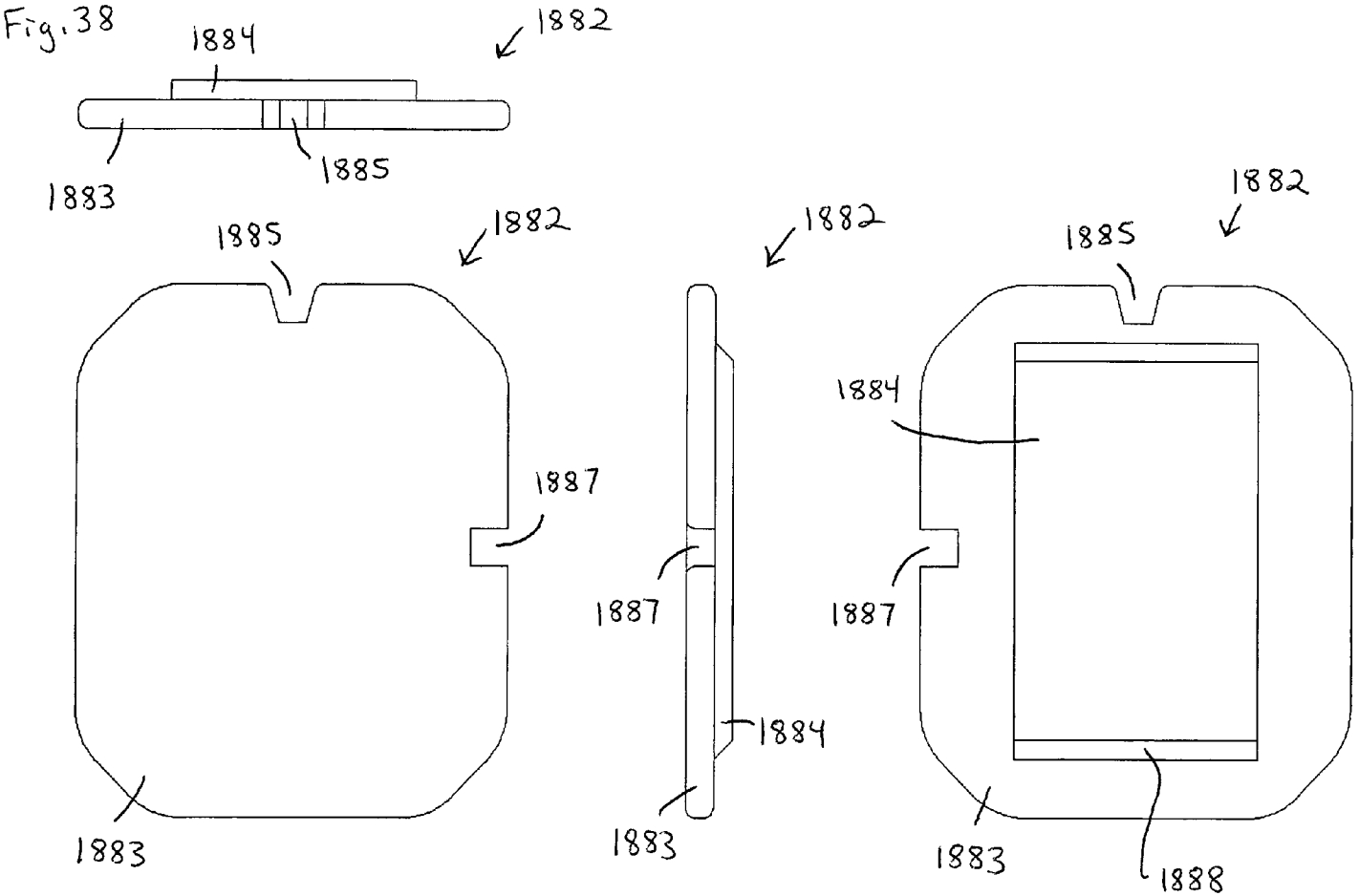
FIG. 37 is an end view of a weight plate that is part of the dumbbell of FIG. 12.
FIG. 38 is a top view of the weight plate of FIG. 37.
FIG. 39 is a side view of the weight plate of FIG. 37.
FIG. 40 is an opposite end view of the weight plate of FIG. 37.

The rail 1860 has an "outboard" face (facing away from the handle 1820) that is smooth except for two rectangular notches 1863 that are spaced the same distance apart as the inner end plates 1830. During manufacture of the depicted embodiment, the rails 1860 are inserted through respective openings 1837 in the inner end plates 1830 and moved "outboard" as shown in FIG. 36. Then, respective bars 1827 are inserted through respective openings 1837 in the inner end plates 1830 to hold the rails 1860 in their respective "outboard" positions. A separate screw is threaded into each hole 1838 (at the interface between a respective bar 1827 and a respective inner end plate 1830) to secure the bars 1827 in place. Each bar 1827 covers an intermediate portion of a respective groove 1867 and cooperates with a respective rail 1860 to define an upwardly opening slot 1828.

Each distal end of the rail 1860 has a protruding, rectangular tab 1864 that is sized and configured for insertion into a respective slot 1846 in a respective outer end plate 1840. Also, a separate circular hole 1866 extends into each end of the rail 1860 to receive a respective screw 1806. In this regard, each hole 1866 is arranged to align with a respective hole 1848 in a respective end plate 1840 when the associated tab 1864 is disposed inside the corresponding slot 1846. In other words, the rails 1860 are rigidly interconnected between the inner end plates 1830 and the outer end plates 1840, thereby defining opposite end weight housings, and each strut 1850 provides reinforcement for a respective weight housing.

Axially spaced, rectangular notches 1865 are cut into the "inboard" side of each end portion of the rail 1860, thereby leaving axially spaced fingers or spacers 1868. The notches 1865 are sized and configured to slidably receive respective weight plates 1881 and 1882. Also, for reasons described below, axially spaced, triangular notches 1869 are cut into the upper "inboard" face on the intermediate portion of the rail 1860.

First and second selector rods 1871 and 1872 are slidably mounted within the grooves 1867 on respective rails 1860. The selector rod 1871, which is identical to the selector rod 1872, is shown by itself in FIGS. 16-17. The selector rod 1871 includes a first, leading portion 1877 that is sized and configured to occupy both the groove 1867 in a respective rail 1860 and the notches 1865 at a respective end of the respective rail 1860, and a second, trailing portion 1878 that is sized and configured to occupy only the groove 1867 in a respective rail 1860. An "inboard" corner 1875 on the leading end of the first portion 1877 is chamfered for reasons described below. Also, a notch 1879 is formed in the "inboard" face of the first portion 1877 to facilitate mounting of a respective selector button 1891 or 1892, as more fully described below.

The selecting button 1891, which is identical to the selecting button 1892, is shown by itself in FIG. 15. An "inboard" portion of the button 1891 is provided with a curved depression 1895 sized and configured to receive a person's thumb. The button 1891 also includes a downwardly extending post 1898 that is sized and configured to fit within the slot 1828. A nub 1899 protrudes "inboard" from the post 1898, and the nub 1899 is sized and configured to fit within any of the notches 1869 in a respective rail 1860. The notch 1879 in the selector rod 1871 is sized and configured to accommodate a spring that is interconnected between the selector rod 1871 and the post 1898 on the button 1891, and operable to bias the nub 1899 "outboard" against the rail 1860. Other biasing arrangements, including ball detents, may be used in addition and/or in the alternative.

One of the weight plates 1882, which is identical to the weight plates 1881, is shown by itself in FIGS. 37-40. The weight plate 1882 includes a main plate 1883 having an upper edge that is interrupted by a trapezoidal notch 1885, and a side edge that is interrupted by a rectangular notch 1887. The trapezoidal notch 1885 is configured and arranged to receive the intermediate portion 1855 of a respective strut 1850 when the handle assembly 1810 is properly aligned relative to the weight plate 1882. The rectangular notch 1887 is configured and positioned to receive the leading portion 1877 of the selector bar 1872 when the handle assembly 1810 is properly aligned relative to the weight plate 1882. The "inboard" edges of the notch 1887 are preferably chamfered or rounded to guide the selector bar 1872 into the notch 1887. The weight plate 1882 also includes a relatively smaller central portion 1884 of the main plate 1883 having beveled upper and lower ends 1888.

The dumbbell 1800 is shown "fully loaded" in FIGS. 12-13. In other words, the selector rod 1871 is disposed within the notch 1887 in each weight plate 1881, and the selector rod 1872 is disposed within the notch 1887 in each weight plate 1882. With the weight plates 1881 and 1882 resting on a suitable cradle, the button 1891 may be pulled "inboard" and moved to the right (in FIG. 12) to disengage one or more of the weight plates 1881, and/or the button 1892 may be moved "inboard" and moved to the left (in FIG. 12) to disengage one or more of the weight plates 1882. A respective notch 1869 is provided in the rail 1860 for each weight plate 1881, and the nub 1899 will snap into a respective notch 1869 to indicate that the associated weight plate 1881 has been properly selected. For example, FIG. 32 shows the selector rod 1871 in a position to engage two weight plates 1881, and FIG. 36 shows the selector rod 1871 in a position to engage four weight plates 1881. As shown in FIG. 12, indicia 1818 may be providing on the rail 1860 to indicate the current weight of the handle assembly 1810. Assuming that the handle assembly 1820 weighs twenty pounds by itself, and that each weight plate 1881 and 1882 weighs five pounds, the dumbbell 1800 is adjustable between twenty and seventy pounds.

Another exercise dumbbell constructed according to the principles of the present invention is designated as 2000 in FIGS. 41-47. The dumbbell assembly 2000 generally includes a base member 2041, first and second selector rods 2020 and 2030 movably mounted on the base member 2041, weights 2050 and 2060 selectively engaged by respective selector rods 2030 and 2020, and a stand 2080 to support the other components when not in use.

The base member 2041 includes a handle 2045 sized and configured for grasping and rigidly interconnected between opposite side members 2042 and 2043. The first selector rod 2020 has parallel prongs 2021 which are interconnected at one end by a generally U-shaped handle 2022 that extends perpendicularly away from the prongs 2021. Similarly, the second selector rod 2030 has parallel prongs 2031 which are interconnected at one end by a generally U-shaped handle 2032 that extends perpendicularly away from the prongs 2031. The prongs 2021 and 2031 are movably connected to the side members 2042 and 2043.

Gear teeth are provided along a "rack" portion of each of the prongs 2021 and 2031. As shown in FIG. 47, a rotary gear 2040 is rotatably mounted on the side member 2042 and disposed between the rack portions of adjacent prongs 2021 and 2031. The gear or pinion 2040 constrains the selector rods 2020 and 2030 to move in opposite directions, through respective openings in the side members 2042 and 2043. Each revolution of the gear 2040 moves each of the selector rods 2020 or 2030 into or out of engagement with a single weight 2060 or 2050, respectively. A biasing means 2049 cooperates with the other set of adjacent prongs 2021 and 2031 to bias the selector rods 2020 and 2030 in place subsequent to each revolution of the gear 2040.

Figure 45:
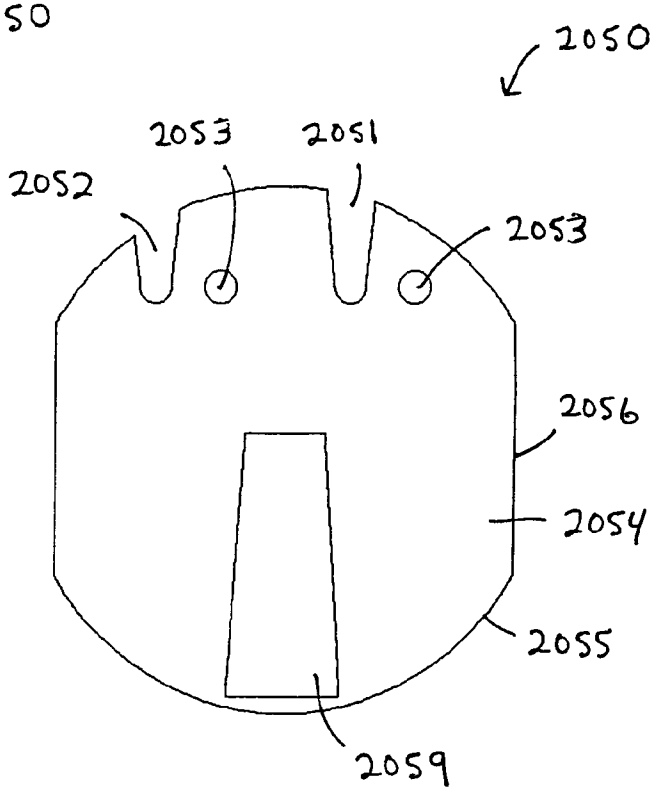
FIG. 45 is an opposite end view of the weight of FIG. 43.
Figure 44:
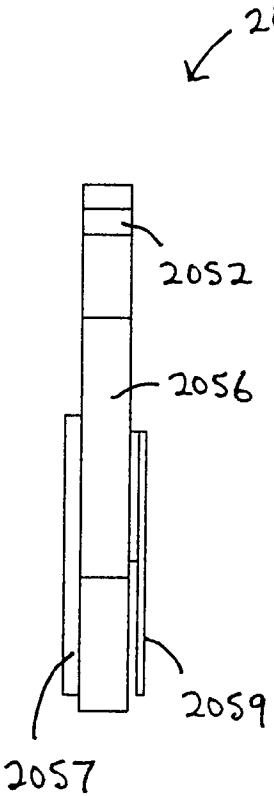
FIG. 44 is a front view of the weight of FIG. 43.
Figure 43:
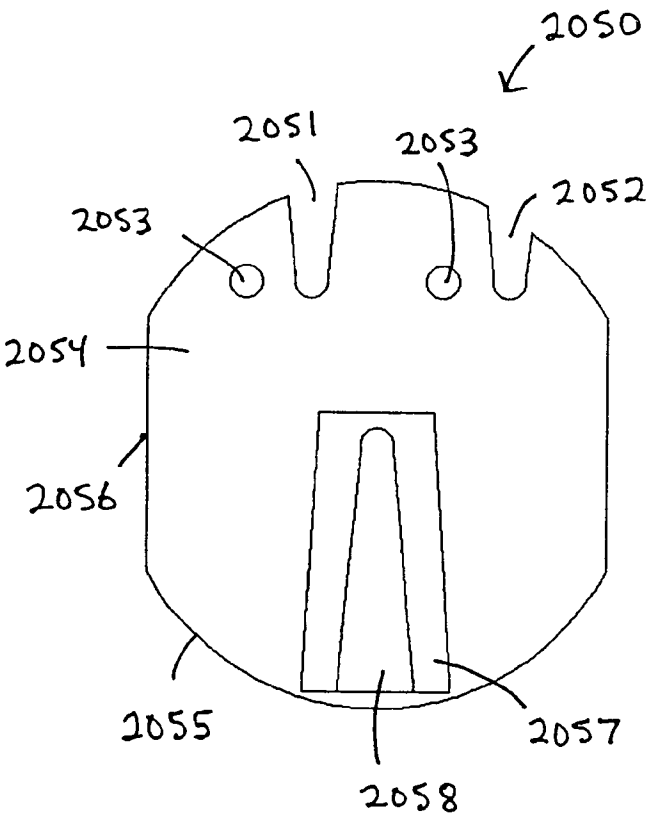
FIG. 43 is an end view of a weight which is part of the dumbbell of FIGS. 41-42.

One of the weights 2050 is shown in greater detail in FIGS. 43-45. The weights 2060 are mirror images of the weights 2050. The weight 2050 may be described as a generally oval plate 2054 having rounded upper and lower edges 2055 and straight side edges 2056. Holes 2053 extend through the plate 2054 to selectively receive the prongs 2031 of the "opposite side" selector rod 2030. Similar holes extend through each of the weights 2060 to receive the prongs 2021 of the "opposite side" selector rod 2020. Slots 2051 and 2052 extend into the plates 2054 to accommodate the "same side" selector rod 2020 and allow it to clear the plate 2054 when the weight 2050 is not selected. Similar slots extend into each of the weights 2060 to accommodate the "same side" selector rod 2030 and allow it to clear same when they are not selected. The slots are bounded by downwardly converging sidewalls to encourage return of the base 2041 to its proper position relative to any "unselected" weights. The weights 2060 and 2050 are selected simply by moving the two selector rods 2020 and 2030 relative to one another and into or out of the holes in the "opposite side" weights.

Members 2057 and 2059 are mounted to opposite sides of the plate 2054 to maintain proper spacing between the weights 2050, and also, to interconnect the weights 2050 in a manner which discourages relative movement in a direction parallel to the handle 2045 but does not interfere with upward movement of an inside weight relative to an adjacent outside weight. Each member 2057 projects away from the handle 2045 and provides a downwardly opening slot 2058. Each member 2059 projects toward the handle 2045 and provides a T-shaped rail sized and configured to slide into the slot 2058 on an adjacent weight. A similar member 2057 is also mounted on the outwardly facing side of each side member 2042 or 2043 to receive the T-shaped rail on the "inwardmost" weight.

A stand or support 2080 for the assembly 2000 is shown in FIGS. 46-46A. The support 2080 includes a flat base 2081 and a pair of boxes 2082 and 2083 extending upward therefrom to support the weights 2050 and 2060 respectively. The upper portion of each box 2082 and 2083 has downwardly convergent sidewalls 2088 which encourage respective weights 2050 and 2060 into alignment with respective boxes 2082 and 2083. The lower portion of each box 2082 and 2083 has straight sidewalls 2086 and a curved bottom wall 2085 which are sized and configured to maintain the respective weights 2050 and 2060 in a stable position. Slots 2084 extend into the inwardly facing sidewalls of the two boxes 2082 and 2083 to accommodate the handle 2045. The walls 2089 of each slot 2084 are downwardly convergent to encourage the handle 2045 into alignment with the support 2080.

Advantages of the embodiment 2000 include that the handle 2040 is relatively more accessible, and that relative few assembly steps are required to manufacture the dumbbell 2000. Given the relatively complicated configuration of the weights 2050 and 2060, it may be desirable to injection mold the exterior of the weights 2050 and 2060 and disposed a relatively heavier material in the interior thereof.

Figure 48:
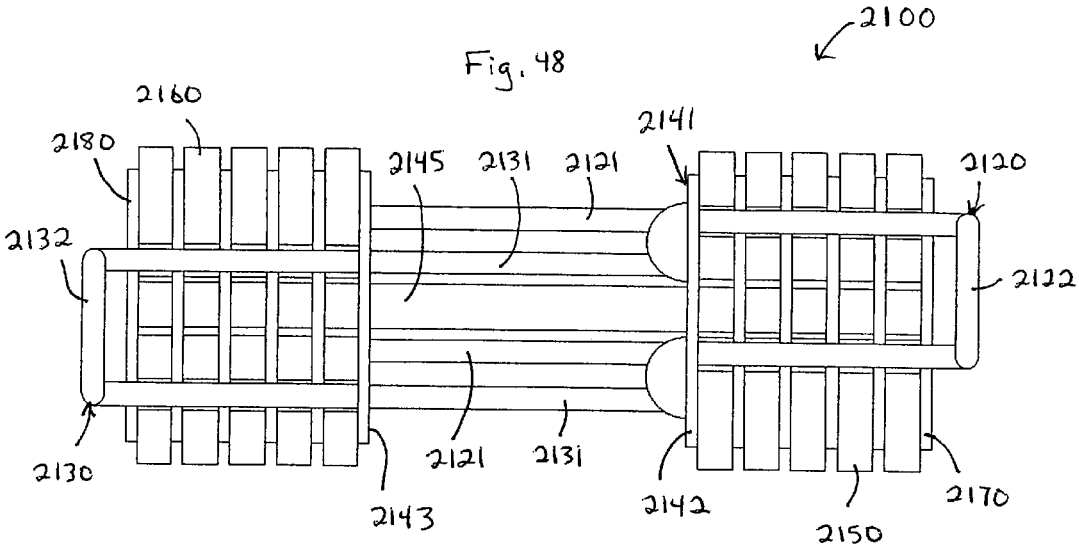
FIG. 48 is a top view of yet another dumbbell constructed according to the principles of the present invention.
Figure 49:
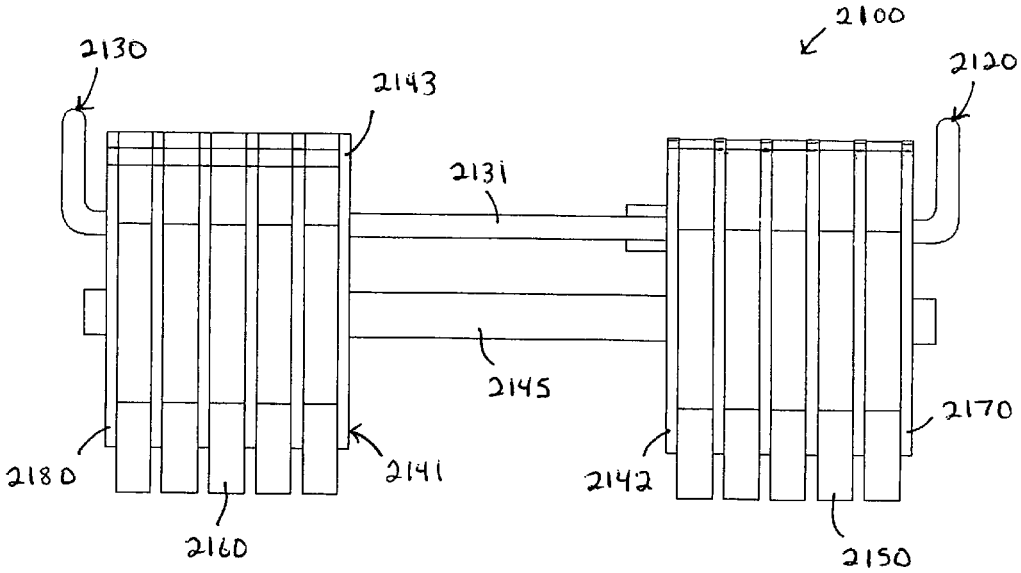
FIG. 49 is a front view of the dumbbell of FIG. 48.

Yet another weight selection assembly constructed according to the principles of the present invention is embodied on an exercise dumbbell that is designated as 2100 in FIGS. 48-49. The dumbbell assembly 2100 is similar in several respects to the previous embodiment 2000. For example, the assembly 2100 similarly includes a base member 2141, first and second selector rods 2120 and 2130 movably mounted on the base member 2141, weights 2150 and 2160 selectively engaged by respective selector rods 2130 and 2120, and a stand (not shown) to support the aforementioned components when not in use. The assembly 2100 also shares some common features with the weight assembly 1770 shown in FIG. 1. For example, the assembly 2100 similarly has spacers 2170 and 2180 secured to opposite sides of a handle 2145 at fixed intervals along the longitudinal axis thereof, and the stand for the assembly 2100 similarly requires a separate slot for each of the weights 2150 and 2160.

The handle 2145 is sized and configured for grasping and is rigidly interconnected between opposite side members 2142 and 2143. The first selector rod 2120 has parallel prongs 2121 which are interconnected at one end by a generally U-shaped handle 2122 that extends perpendicularly away from the prongs 2121. Similarly, the second selector rod 2130 has parallel prongs 2131 which are interconnected at one end by a generally U-shaped handle 2132 that extends perpendicularly away from the prongs 2131. The prongs 2121 and 2131 are inserted through holes in (and thereby movably connected to) the side members 2142 and 2143.

Gear teeth are provided along a "rack" portion of each of the prongs 2121 and 2131. As shown in FIG. 50, a rotary gear 2140 is rotatably mounted on the side member 2142 and interconnected between the rack portions of adjacent prongs 2121 and 2131. The gear or pinion 2140 constrains the selector rods 2120 and 2130 to move in opposite directions, through the holes in the side members 2142 and 2143. Each revolution of the gear 2040 moves each of the selector rods 2120 or 2130 into or out of engagement with a single weight 2160 or 2150, respectively. A biasing means 2149 biases the selector rods 2120 and 2130 in place subsequent to each revolution of the gear 2140.

One of the spacers 2170 is shown in greater detail in FIG. 51. The spacers 2180 are reversed images of the spacers 2170. The spacer 2170 may be described as a generally oval plate having rounded upper and lower edges and straight side edges. A hole 2174 extends through the spacer 2170 to receive the handle 2145. The spacers 2170 and 2180 (as well as the side members 2142 and 2143) may be secured to the handle 2145 in various manners known in the art, including integral molding, in which case a reinforcing shaft may be inserted lengthwise through the handle 2145. Holes 2173 extend through the spacer 2170 to selectively receive the prongs 2131 of the "opposite side" selector rod 2130. Similar holes extend through each of the spacers 2180 to receive the prongs 2121 of the "opposite side" selector rod 2120. Slots 2171 and 2172 extend into the spacers 2170 to accommodate the "same side" selector rod 2120 and allow it to clear the spacer 2170 when "outboard" weights are not selected. Similar slots extend into the spacers 2180 to accommodate the "same side" selector rod 2130 and allow it to clear same when corresponding "outboard" weights are not selected.

One of the weights 2150 is shown in greater detail in FIG. 52. The weights 2160 are mirror images of the weights 2150. The weight 2150 may be described as a generally oval plate having rounded upper and lower edges and straight side edges. A relatively large slot 2154 extends into the weight 2150 to accommodate the handle 2145. Holes 2153 extend through the weight 2150 to selectively receive the prongs 2131 of the "opposite side" selector rod 2130. Similar holes extend through each of the weights 2160 to receive the prongs 2121 of the "opposite side" selector rod 2120. Relatively smaller slots 2151 and 2152 extend into the weight 2150 to accommodate the "same side" selector rod 2120 and allow it to clear the weight 2150 when it is not selected. Similar slots extend into each of the weights 2160 to accommodate the "same side" selector rod 2130 and allow it to clear same when it is not selected.

The slots are bounded by downwardly converging sidewalls to encourage return of the base 2141 to its proper position relative to any "unselected" weights. The weights are selected by moving the two selector rods 2120 and 2130 relative to one another and into or out of the holes in the "opposite side" weights. Any "unselected" weights remain in place on a stand or other support when the base 2141 is lifted away from the stand. It may be desirable to bevel leading edges to encourage proper insertion of parts which move relative to one another. For example, a lower distal portion of each spacer 2170 and 2180 may be made relatively thinner, and an upper distal portion of each weight 2150 and 2160 may be made relatively thinner, in order to provide a more forgiving tolerance as the former are lowered into adjacent and alternating positions relative to the latter.

Figure 53:
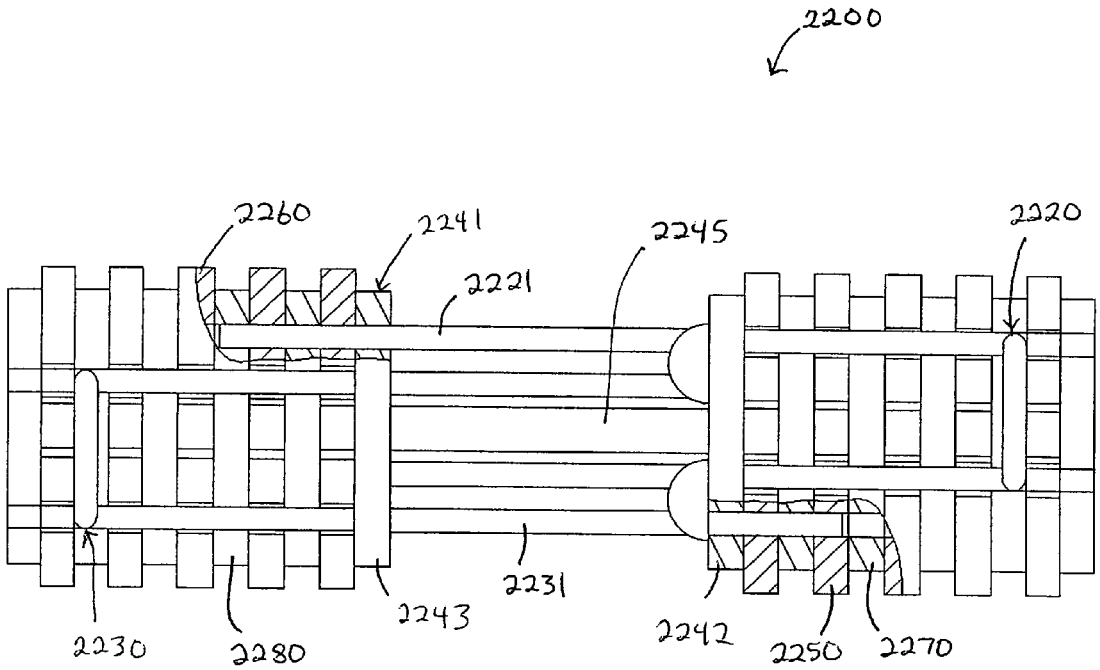
FIG. 53 is a partially sectioned top view of yet another exercise dumbbell constructed according to the principles of the present invention.
Figure 54:
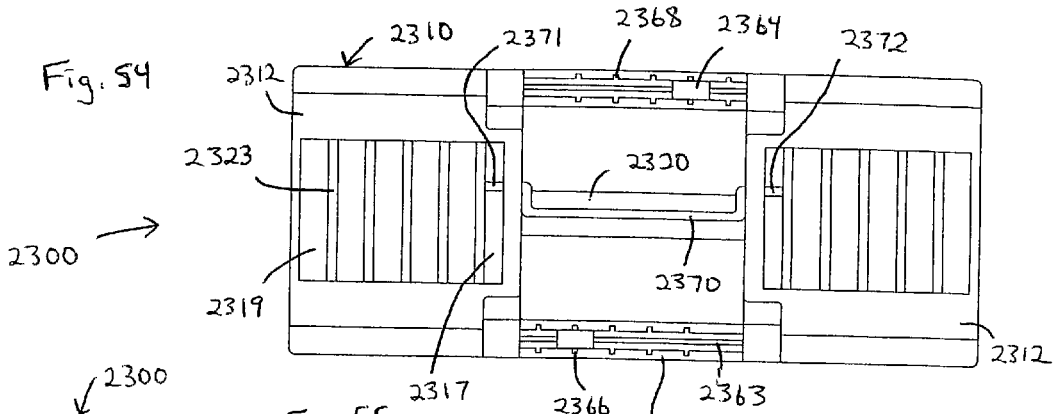
FIG. 54 is a top view of still another exercise dumbbell constructed according to the principles of the present invention.

Another design consideration is the width of the spacers disposed between the weights. For example, as shown in FIG. 53, a dumbbell similar to the assembly 2100 has relatively wider spacers 2270 disposed between weights 2250, and relatively wider spacers 2280 disposed between weights 2260, as well as a handle 2245 interconnected between the spacers 2270 and 2280. The relatively wider spacers 2270 and 2280 (and side members 2242 and 2243) provide a greater margin for error with regard to the positions of prongs 2221 and 2231 on respective selector rods 2220 and 2230. In this case, the width of the spacers 2270 and 2280 is sufficient to allow the selector rods 2220 and 2230 to be out of phase, so to speak. In particular, each revolution of the pinion gear (not shown) causes only one of the selector rods 2220 or 2230 to engage an additional weight 2260 or 2250, while the other selector rod moves into engagement with the next spacer 2280 or 2270. For example, the assembly 2200 is shown in FIG. 53 to have engaged two weights on each side of the base 2241. One more turn of the pinion gear will cause the selector rod 2220 to engage a third weight 2260, and the selector rod 2230 to engage a second spacer 2270. Such an arrangement allows twice as many weight adjustments, or in other words, weight adjustments in increments one-half as great, for a given number of weights on the assembly 2200.

Yet another design consideration is the configuration of the weights on any particular assembly. For example, those skilled in the art may recognize the desirability of making the an upper half or a lower half of the weights a different size, and/or locating the handle slightly off center relative to the weights, in order to compensate for the weight of the selector rods and/or the portions removed from the upper portions of the weights. Those skilled in the art will also recognize that these two eccentricities may be engineered to more or less balance each other. The spacers 2170 and 2180 are shown "offset" for purposes of illustration, recognizing that the weight of the spacers may render this "offset" insignificant in the embodiment shown.

FIGS. 54-61 show a dumbbell 2300 constructed according to the principles of the present invention, and having two different weight selection systems, including a half-weight selection system that uses a dedicated selector rod 2370. Generally speaking, the dumbbell 2300 includes a handle 2320 and downwardly opening boxes 2312 secured to opposite ends of the handle 2320, thereby defining a handle assembly 2310. Opposite side supports 2360 are also interconnected between the boxes 2312 to house respective, opposite side selector rods 2361 and 2362, as well as contribute to the structural integrity of the handle assembly 2310. Each of the boxes 2312 is divided into weight receiving compartments 2317 and 2319 by means of walls or spacers 2323. The innermost compartment 2317 on each end of the base 2310 is sized and configured to receive a relatively smaller weight plate 2380, and the remaining compartments 2319 on each end of the base 2310 are sized and configured to receive relatively larger weight plates 2390, which preferably weigh twice as much as the plates 2380.

Figures 57, 58, 59, 60:
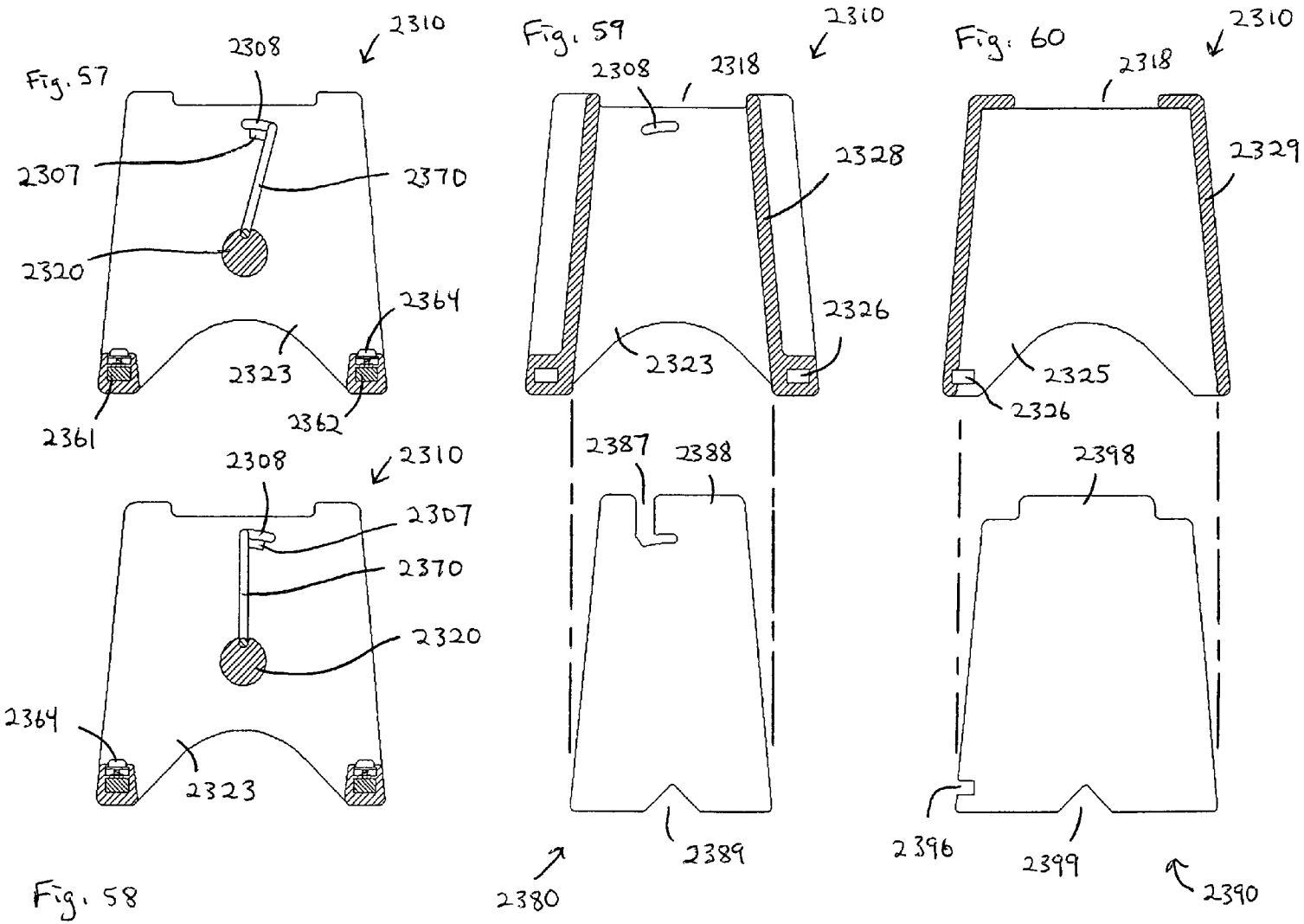
FIG. 57 is a sectioned end view of the handle assembly shown in FIG. 55.
FIG. 58 is a sectioned end view of the handle assembly of FIG. 57, with a supplemental selector rod in a different orientation.
FIG. 59 is another sectioned end view of the handle assembly of FIG. 55, shown in alignment with one of the supplemental weight plates of FIG. 55.
FIG. 60 is yet another sectioned end view of the handle assembly of FIG. 55, shown in alignment with one of the primary weight plates shown in FIG. 55.

A separate selector rod 2370 is provided to selectively engage only the "half-weights" 2380. The selector rod 2370 has first and second weight engaging segments 2371 and 2372 which project into respective compartments 2317, and which are rigidly interconnected by a radially offset intermediate segment that nests within the handle 2320. As shown in FIGS. 57-58, the segments 2371 and 2372 project through respective arcuate slots 2308, and the selector rod 2370 is rotatable between opposite ends of the slot 2308. Nubs 2307 project outward from the opposing faces of the innermost walls 2323 to discourage undesired movement of the selector rod 2370 from one orientation to the other.

As shown in FIG. 59, which constitutes an opposite end view relative to those of FIGS. 57-58, the weight plate 2380 fits between opposite sidewalls 2328 on the base 2310, and the slot 2308 aligns with the lower portion of an opening 2387 in the plate 2380. The upper portion of the opening 2387 extends vertically upward from the lower portion to the upper edge 2388 of the plate 2380. When the respective weight engaging segment 2371 or 2372 is vertically aligned with the upper portion of the opening 2387, the selector rod 2370 and the remainder of the base 2310 are free to move upward relative to the weight plate 2380. On the other hand, when the respective weight engaging segment 2371 or 2372 is rotated to an opposite end of the lower portion of the opening 2387, the weight plate 2380 is constrained to move upward (and elsewhere) together with the selector rod 2380 and the remainder of the base 2310.

As shown in FIG. 60, the weight plate 2390 fits between opposite sidewalls 2329 on the base 2310, and a notch 2396 in the weight plate 2390 aligns with an opening 2326 extending through adjacent portions of the spacers 2325 (and 2323) and one of the sidewalls 2329. In the absence of a respective selector rod 2361 or 2362, the base 2310 is free to move upward relative to the weight plate 2390. On the other hand, when a respective selector rod 2361 or 2362 is moved through the notch 2396, the associated weight plate 2390 is constrained to move upward (and elsewhere) together with the base 2310. The upper end 2398 of the weight plate 2390 is shaped similar to the upper end 2388 of the half-weight plate 2380, and both are sized and configured to fit through respective openings 2318 in the base 2310.

Figure 61:
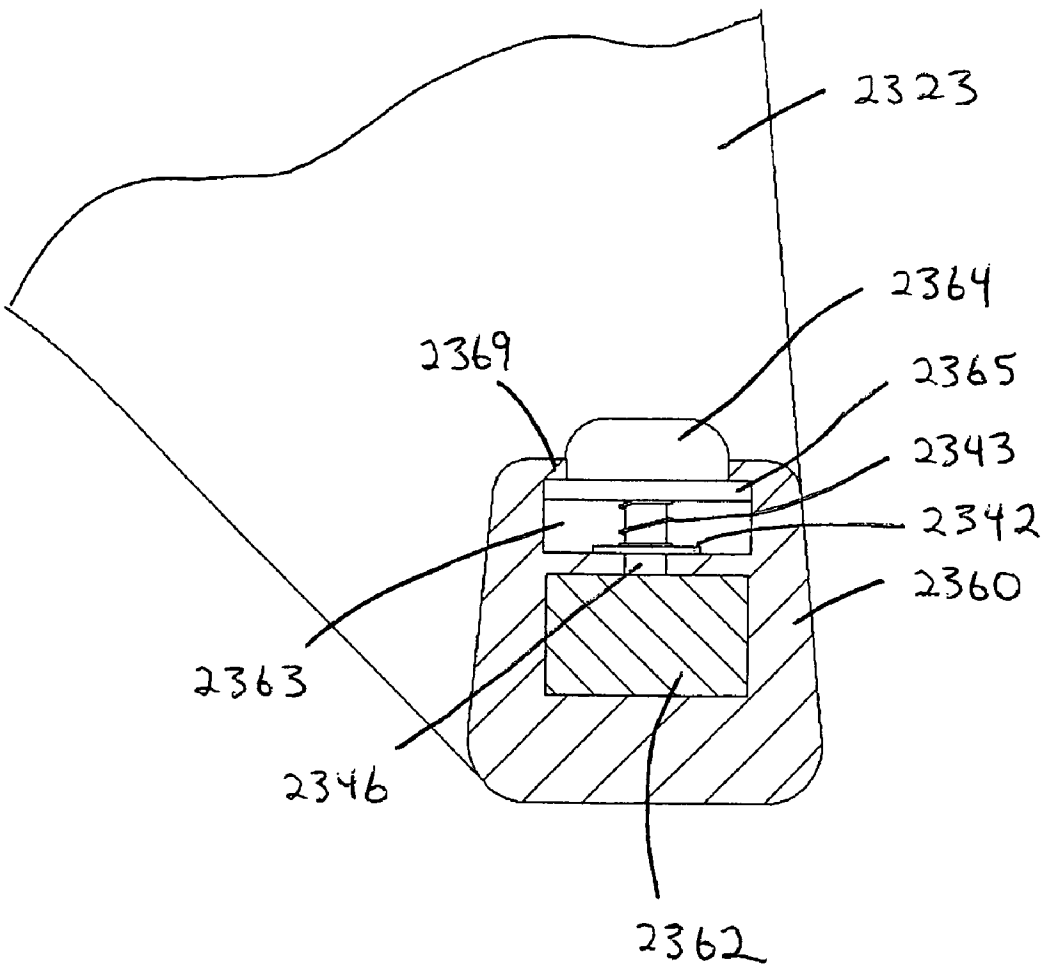
FIG. 61 is an enlarged, sectioned end view of a portion of the handle assembly shown in FIGS. 57-58.

Each of the selector rods 2361 and 2362 is independently movable into engagement with a desired number of weight plates 2390 on a respective end of the dumbbell 2300. FIG. 61 shows how the selector rod 2362 is moved and biased to remain in a desired position relative to the base 2310. The support 2360 is provided with a channel 2363 disposed above the opening 2326. A post 2346 is rigidly secured to the selector rod 2362 and extends upward through the channel 2363. A stop 2342 is rigidly secured to an intermediate portion of the post 2346 and occupies a lowermost position within the channel 2363. A button 2364 is slidably mounted on the post 2346, and opposite sides of a bottom plate 2365 on the button 2364 extend beneath opposing shoulders 2369 on the support 2360 to retain the button 2364 within the channel 2363. A spring 2343 is compressed between the plate 2365 and the stop 2342 to bias the button 2364 upward against the shoulders 2369. The plate 2365 is provided with opposite side tabs 2366 which project upward and engage opposite side openings 2368 in the shoulders 2369. The distance between openings 2368 is equal to the combined thickness of a weight plate 2390 and a spacer 2323.

Figure 55:
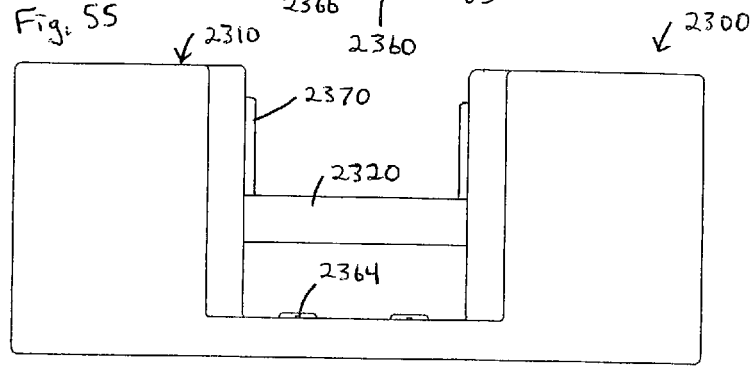
FIG. 55 is a front view of components of the dumbbell of FIG. 54, including a dumbbell handle assembly, weight plates, and a weight plate holder in alignment relative to one another.
Figure 55:
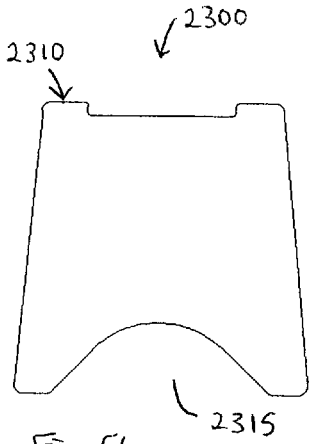
Figure 56:
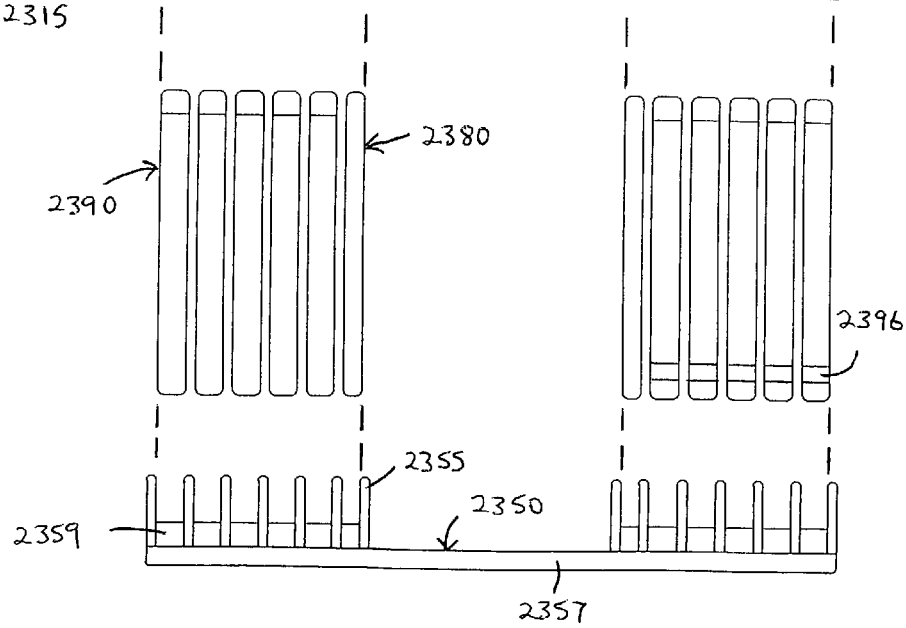
FIG. 56 is an end view of the handle assembly shown in FIG. 55.

FIG. 55 shows a cradle 2350 suitable for holding the weight plates 2380 and 2390 when not in use. The cradle 2350 includes a bottom wall 2357 and spacers 2355 that extend upward from the bottom wall 2357 and align with the walls 2323 and 2325 on the base 2310. The spacers 2355 are sized and configured to fit within the notches 2315 in the walls 2323 and 2325 (shown in FIG. 54). A ridge 2359, having a V-shaped profile, extends upward from the bottom wall 2357 of the cradle 2350 and cooperates with similarly sized and shaped notches 2389 and 2399 in respective weight plates 2380 and 2390 to maintain same in position relative to one another.

Assuming that the base 2310 weighs ten pounds, and the plates 2380 weigh two and one-half pounds each, and the plates 2390 weight five pounds each, the dumbbell 2300 is capable of providing balanced weight resistance of ten pounds to sixty-five pounds in increments of five pounds. If balance is not a critical concern, the plates 2380 could alternatively weigh one and one-quarter pounds each in order to provide increments of two and one-half pounds (with the five pound increments provided by engaging an additional plate 2390 on only one end of the dumbbell 2300).

The foregoing embodiment 2300 may also be described in terms of an adjustable exercise weight system, comprising: a base which includes a handle and weight supports at opposite ends of the handle; weights sized and configured for engagement by the weight supports; and selector rods which are movable axially relative to the handle and into engagement with any of the weights at respective ends of the handle. The selector rods may be nested within sidewalls which form the weight supports and/or may be stored between the weights. In addition and/or the alternative, secondary weights may be provided for selection by alternative means and without interfering with operation of the selector rods. One such secondary system includes opposite side selector segments which are simultaneously movable into engagement with respective secondary weights and/or are radially offset relative to an intermediate segment interconnected therebetween.

The present invention may also be described in terms of various methods, including, for example, a method of providing adjustable resistance to exercise, comprising the steps of disposing weights on opposite first and second sides of a base member; movably mounting first and second bars on the base member; moving the first bar in a first direction relative to the base member and into engagement with a desired number of the weights on the first side of the base member; and moving the second bar in a second, opposite direction relative to the base member and into engagement with a desired number of the weights on the second side of the base member. This method may further involve the steps of providing a hole through each of the weights on the first side of the base member to receive the first bar, and providing a hole through each of the weights on the second side of the base member to receive the second bar. Also, a groove may be provided in each of the weights on the first side of the base member to accommodate the second bar, and a groove may be provided in each of the weights on the second side of the base member to accommodate the first bar. The first bar and the second bar may be constrained to engage a like number of weights and/or to move together in opposite directions. Such constraints may involve provision of racks of gear teeth on the first bar and the second bar, and mounting of a rotary gear on the base member between the racks on the first bar and the second bar. In the alternative, the bars may be arranged for movement independent of one another.

The method may also involve the step of maintaining each of the weights a fixed distance from the base member and/or maintaining each of the weights a fixed distance from adjacent weights. In this regard, weight spacers and/or support rails may be provided on the base member and/or on the weights themselves, and they may even extend between the weights on the first side of the base member and the weights on the second side of the base member.

Further steps may include attaching a plastic support to each of the weights to facilitate engagement by a respective bar, and/or providing a housing sized and configured to accommodate the base member and the weights, and to support any non-engaged weights upon removal of the base member. In addition to the housings disclosed herein, examples of other weight cradles are disclosed in U.S. Pat. No. 4,284,463 to Shields; U.S. Pat. No. 4,529,198 to Hettick; U.S. Pat. No. 4,822,034 to Shields; U.S. Pat. No. 5,769,762 to Towley; and U.S. Pat. No. 5,839,997 to Roth et al., all of which are incorporated herein by reference.

A handle may be provided on the base member, preferably disposed between the weights on the first side and the weights on the second side. A groove may be provided in each of the weights to accommodate the handle, and/or the base member and the weights may be configured to collectively define keyways sized and configured to receive the first bar and the second bar.

The weights may be constrained to move through defined paths. Furthermore, additional weights may be disposed in a stack beneath the base member, and a selector rod may be inserted through the stacked weights. Moreover, the selector rod may be configured to rotate into engagement with a desired number of stacked weights. In this case, a rack of gear teeth may be provided on each of the first bar and the second bar; a gear may be rotatably mounted on the base member between the rack on the first bar and the rack on the second bar (to constrain the first bar and second bar to move in opposite directions); and the output shaft of a motor may be moved from a first position, engaging the gear, to a second position, engaging the selector rod.

Those skilled in the art will also recognize that features of various methods and/or embodiments may be mixed and matched in numerous ways to arrive at still more variations of the present invention. Recognizing that those skilled in the art are likely to derive many additional embodiments and/or improvement from this disclosure, the scope of the present invention should be limited only to the extent of the following claims.

What is claimed is:

1. A method of adjusting resistance to exercise, comprising the steps of:

positioning a plurality of weights in respective rest positions;

moving a member into and out of alignment with the weights;

moving a weight selector on the member along a linear path, including a first portion of the path that extends over an upwardly unbounded portion of each weight in a first subset of the weights, thereby leaving the weight selector free to move upward relative to the first subset, and a second portion of the path that extends beneath at least a portion of each weight in a discrete, second subset of the weights, to selectively secure the second subset to the member for upward movement together with the weight selector.

2. The method of claim 1, wherein the member has a first end portion, a second end portion, and an intermediate handle secured therebetween, and some of the weights are positioned in alignment with the first end portion, and some of the weights are positioned in alignment with the second end portion.

3. The method of claim 2, wherein the handle defines a longitudinal axis, and the second moving step involves movement of the weight selector parallel to the axis.

4. The method of claim 1, further comprising the step of moving a second weight selector on the member linearly over an upwardly unbounded portion of each said weight in the second subset of the weights, thereby leaving the second weight selector free to move upward relative to the second subset, and beneath at least a portion of each said weight in the first subset of the weights to selectively secure the first subset to the member for upward movement together with the second weight selector.

5. An adjustable weight exercise device, comprising:

a plurality of weights disposed in respective aligned positions; and a member sized and configured for movement into and out of alignment with the weights, wherein a weight selector is movably mounted on the member for movement along a linear path that extends over an upwardly exposed sidewall of each weight in a first subset of the weights, thereby leaving the weight selector free to move upward relative to the first subset, and beneath at least a portion of each weight in a discrete, second subset of the weights, thereby constraining the second subset to move upward together with the weight selector.

6. The device of claim 5, wherein the member has a first end portion, a second end portion, and an intermediate handle secured therebetween, and some of the weights align with the first end portion, and some of the weights align with the second end portion.

7. The device of claim 6, wherein the handle defines a longitudinal axis, and the weight selector moves parallel to the axis.

8. The device of claim 5, further comprising a second weight selector movably mounted on the member for linear movement over an upwardly exposed sidewall of each said weight in the second subset of the weights, thereby leaving the weight selector free to move upward relative to the second subset, and beneath at least a portion of each said weight in the first subset of the weights, thereby constraining the first subset to move upward together with the second weight selector.

9. A method of adjusting resistance to exercise, comprising the steps of:

positioning a plurality of weights in respective rest positions;

moving a member into and out of alignment with the weights;

moving a first weight selector on the member linearly over an upwardly unobstructed sidewall of each weight in a first subset of the weights, leaving the first weight selector free to move upward relative to the first subset, and beneath at least a portion of each weight in a discrete, second subset of the weights to selectively secure the second subset to the member for upward movement together with the first weight selector; and moving a second weight selector on the member linearly over an upwardly unobstructed sidewall of each said weight in the second subset of the weights, leaving the second weight selector free to move upward relative to the second subset, and beneath at least a portion of each said weight in the first subset of the weights to selectively secure the first subset to the member for upward movement together with the second weight selector.

10. An adjustable weight exercise device, comprising:

a plurality of weights disposed in respective aligned positions; and a member sized and configured for movement into and out of alignment with the weights, wherein a first weight selector is movably mounted on the member for linear movement over an upwardly open sidewall of each weight in a first subset of the weights, leaving the first weight selector free to move upward relative to the first subset, and beneath at least a portion of each weight in a discrete, second subset of the weights, constraining the second subset to move upward together with the first weight selector, and a second weight selector is movably mounted on the member for linear movement over an upwardly open sidewall of each said weight in the second subset of the weights, leaving the second weight selector free to move upward relative to the second subset, and beneath at least a portion of each said weight in the first subset of the weights, constraining the first subset to move upward together with the second weight selector.

* * * * *